US011058181B2

(12) United States Patent
McKenzie et al.

(10) Patent No.: US 11,058,181 B2
(45) Date of Patent: Jul. 13, 2021

(54) DEVICES AND METHODS FOR SECURING KNOTS

(71) Applicant: Y-KNOT, LLC, Newtown Square, PA (US)

(72) Inventors: Allyson A. McKenzie, Newtown Square, PA (US); Joseph M. Vaccaro, West Chester, PA (US)

(73) Assignee: Y-Knot, LLC, Newtown Square, PA (US)

( * ) Notice: Subject to any disclaimer, the term of this patent is extended or adjusted under 35 U.S.C. 154(b) by 0 days.

(21) Appl. No.: 16/344,432

(22) PCT Filed: Oct. 25, 2017

(86) PCT No.: PCT/US2017/058233
§ 371 (c)(1),
(2) Date: Apr. 24, 2019

(87) PCT Pub. No.: WO2018/081230
PCT Pub. Date: May 3, 2018

(65) Prior Publication Data

US 2020/0054095 A1 Feb. 20, 2020

Related U.S. Application Data

(60) Provisional application No. 62/412,545, filed on Oct. 25, 2016.

(51) Int. Cl.
*A43C 7/00* (2006.01)
*A43C 7/04* (2006.01)

(52) U.S. Cl.
CPC ..... *A43C 7/005* (2013.01); *A43C 7/04* (2013.01)

(58) Field of Classification Search
CPC .. A43C 7/005; A43C 7/04; E05D 1/00; E05D 1/02
See application file for complete search history.

(56) References Cited

U.S. PATENT DOCUMENTS 428,758 A * 5/1890 Mayfield ..... A43C 7/005 24/712.2
819,884 A * 5/1906 Higgins ..... A43C 7/04 24/712.6
3,176,362 A * 4/1965 Tames ..... A43C 7/005 24/712.2
3,290,745 A * 12/1966 Maxwell ..... A43C 7/04 24/712.2
3,473,198 A * 10/1969 Meier ..... A43B 3/0078 24/712.3

(Continued)

FOREIGN PATENT DOCUMENTS

DE 202013005657 U1 8/2013
WO 88/06011 A1 8/1988

OTHER PUBLICATIONS

International Search Report and Written Opinion for International Patent Application Serial No. PCT/US2017/058233 (dated Jan. 23, 2018).

*Primary Examiner* — Jason W San
(74) *Attorney, Agent, or Firm* — Troutman Pepper Hamilton Sanders LLP

(57) ABSTRACT

The present disclosure generally relates to devices and methods for securing shoelace knots by clamping an individual knot between two movable plates.

12 Claims, 21 Drawing Sheets

(56) References Cited

U.S. PATENT DOCUMENTS 4,008,512 A * 2/1977 Prodel ..... F16L 3/2334 24/16 PB
4,666,068 A * 5/1987 Bush ..... B65D 47/0885 222/546
5,022,127 A * 6/1991 Ang ..... A43C 7/005 24/712.2
5,566,427 A * 10/1996 Lathrop ..... A44B 11/06 2/452
5,649,342 A * 7/1997 D'Andrade ..... A43C 7/005 24/712.2
5,979,095 A * 11/1999 Schneider ..... G09F 3/005 24/704.1
6,247,214 B1 * 6/2001 Hyde ..... A43C 7/005 24/712.6
6,382,476 B1 * 5/2002 Randall ..... B65D 47/0885 215/237
6,935,543 B2 * 8/2005 DeGroot ..... B65D 47/0804 222/556
7,152,286 B2 * 12/2006 Rooney ..... A43B 1/0054 24/712.6
7,407,353 B2 * 8/2008 George ..... B60P 7/0869 410/41
8,739,373 B1 * 6/2014 Berman ..... A43C 7/04 24/712.6
10,597,204 B2 * 3/2020 Levy ..... B65D 47/286
2004/0172850 A1 * 9/2004 King, Jr. ..... A43B 3/0031 36/50.1
2006/0248693 A1 * 11/2006 Walker ..... A43C 7/005 24/712.2
2008/0301918 A1 * 12/2008 Tai ..... A43C 7/04 24/712.2
2011/0191992 A1 8/2011 Chen
2011/0266384 A1 11/2011 Goodman et al.
2013/0111717 A1 * 5/2013 Rogers ..... A43C 7/005 24/712.3
2013/0276266 A1 * 10/2013 Pendarvis ..... E05D 1/02 16/225
2013/0318756 A1 * 12/2013 Becker ..... A43C 7/005 24/712.3
2014/0020263 A1 * 1/2014 Theuvenet ..... A43B 3/001 36/50.1
2014/0143979 A1 * 5/2014 Winkler ..... E05F 3/22 16/71
2015/0040360 A1 2/2015 Manganaro et al.
2015/0143717 A1 * 5/2015 Billings ..... A43B 3/0078 36/83
2015/0296923 A1 * 10/2015 Sterling ..... A43C 7/04 24/712.6
2016/0081432 A1 * 3/2016 Caron ..... A43C 7/005 36/50.1
2016/0166008 A1 * 6/2016 Sargissian-Sarian ..... A43C 7/005 24/712.2
2016/0353842 A1 * 12/2016 Langvin ..... A43B 3/0031
2018/0263330 A1 * 9/2018 Rhoads ..... A43C 7/02
2019/0203510 A1 * 7/2019 Alfredsson ..... E05D 7/1061
2019/0343234 A1 * 11/2019 Pelkofer ..... A43C 7/005
2020/0146399 A1 * 5/2020 Lee ..... A43C 7/005

* cited by examiner

DEVICES AND METHODS FOR SECURING KNOTS

FIELD

The present disclosure generally relates to devices and methods for securing knots.

BACKGROUND

It is the nature of knots to come untied. Shoelace knots in particular are more susceptible to coming untied than most types of knots due to a variety of factors including, but not limited to, the skill of the person tying the knot, the strain on the knot due to the natural movement of the shoe, and collisions and abrasions of the knot against foreign surfaces. Such factors are especially acute with those of limited hand strength, such as young children or older adults. Thus, what is needed is a device that is capable of easily and quickly securing a shoelace knot, preventing the knot from coming untied.

SUMMARY

The present disclosure provides devices that secures a knot, preventing it from easily coming untied. In some embodiments, the devices comprise: a) a base section comprising: i) base plate comprising at least a top base surface, and ii) a base post positioned on and operably connected to the top base surface, the base post comprising a hollow upper cylinder with threaded walls; and b) a top section comprising: i) a grabber comprising: a grabber plate comprising a top grabber surface; and a bottom grabber surface, wherein the grabber plate comprises an opening, and a grabber ring positioned on and operably connected to the top grabber surface; ii) a cover comprising: a cover plate comprising a top cover surface and a bottom cover surface, a cover ring operably connected to an outer edge of the cover plate, and a cover post positioned on and operably connected to the bottom cover surface, wherein the cover post comprises a threaded outer surface; and iii) a spring radially disposed around the cover post; wherein the grabber ring is operably connected to the cover ring such that the grabber and the cover are configured to have independent radial movement while maintaining the position of the spring; and wherein the threaded outer surface of the cover post is operably connected to the threaded walls of the upper cylinder in the base post, and the base post is positioned within the opening in the grabber plate.

The present disclosure also provides devices comprising: a) a base section comprising: i) a base plate comprising at least a top base surface, and at least a first notch positioned along the outer edge of the base plate, and at least two lower notch tabs, each positioned separately along the outer edge of the base plate and on either side of the at least first notch; and ii) a base post comprising a hollow upper cylinder with threaded walls therein, positioned on and operably connected to the center of the top base surface, wherein the base post further comprises a hollow lower cylinder positioned below the upper cylinder, wherein the lower cylinder comprises smooth walls on the inside of the cylinder, wherein the lower cylinder has a larger diameter than upper cylinder; b) a top section comprising: i) a grabber comprising: a grabber plate comprising a top grabber surface, a bottom grabber surface, and at least one upper notch tab positioned along the outer edge of the grabber plate and above the at least a first notch of the base plate, and a grabber ring positioned on and operably connected to the top grabber surface, wherein the grabber plate comprises an opening therein; ii) a cover comprising: a cover plate comprising a trap cover surface and a bottom cover surface, a cover ring operably connected to an outer edge of the cover plate, a cover post positioned on and operably connected to the center of the bottom cover surface, wherein the cover post comprises a threaded outer surface and wherein the cover post comprises a hollow inner cylinder positioned substantially in the center of the cover post, wherein the hollow inner cylinder comprises threaded walls on the inside of the cylinder, and a textured grip positioned on the outside of the cover ring; and iii) a spring radially disposed around the cover post; wherein the grabber ring is operably connected to the cover ring, such that the grabber and the cover are configured to have independent radial movement while maintaining the position of the spring; c) a fastener and a washer, wherein the threads of the fastener are positioned through the washer and into the inner cylinder of the cover, and wherein the head of the fastener and the washer are positioned within the lower cylinder of the base section; wherein the threaded outer surface of the cover post is operably connected to the upper cylinder of the base post, and the base post is positioned within the opening in the grabber plate; wherein the base post is or is approximately flat on at least one side, and the opening in the grabber plate is configured to receive the base post, such that the base post is positioned within the opening in the grabber plate and the grabber is configured to, not rotate around the base section; wherein the top base surface, the bottom grabber surface, or both further comprises one or more of the following: a series of ridges, grooves, bumps and points; and wherein the cover is configured to rotate such that the cover post is moved further into the upper cylinder in the base post, the top base surface moves towards the bottom grabber surface; and the top base surface is configured to move away from the bottom grabber surface when the cover is rotated such that the cover post is moved further out of the upper cylinder in the base post.

The present disclosure also provides methods for securing a knot with a device described herein, the methods comprising: a) placing the knot between the bottom grabber surface and the top base surface: and b) rotating the cover such that the bottom grabber surface moves towards the top base surface, until both the bottom grabber surface and the top base surface are in contact with the knot.

The present disclosure also provides devices comprising: a) a base section comprising: i) a base plate comprising at least a top base surface, and ii) a rear post positioned on and operably connected to the top base surface, the rear post comprising a first and a second rivet mount; and b) a top section comprising: i) a grabber comprising: a grabber plate comprising a top grabber surface and a bottom grabber surface, and a grabber body positioned on and operably connected to the top grabber surface, wherein the grabber body comprises a hollow inner cylinder; ii) a cover comprising: a cover plate comprising a top cover surface and a bottom cover surface, a cover ring, operably connected to an outer edge of the cover plate, and a cover post comprising a cover rivet mount; and iii) a top spring disposed within the inner cylinder of the grabber body; wherein the grabber body is operably connected to the cover ring, such that the grabber and the cover are configured to have independent vertical movement while maintaining the position of the top spring in the slot of the grabber body, wherein the rear post is operably connected to the cover post by a rivet positioned through the first and the second rivet mounts and the cover rivet mount.

The present disclosure also provides devices comprising: a) a base section comprising: i) a base plate comprising at least a top base surface, ii) a rear post positioned on and operably connected to the top base surface, the rear post comprising a first and a second rivet mount, iii) at least a first locking tab positioned along the outer edge of the base plate, iv) a button tab positioned along the outer edge of the base plate and below the at least a first locking tab, and v) a base plate notch in the center of or in approximately the center of the base plate; b) a top section comprising: i) a grabber comprising: a grabber plate comprising a top grabber surface and a bottom grabber surface, a grabber body positioned on and operably connected to the top crabber surface, wherein the grabber body comprises a hollow inner cylinder, and a grabber plate notch in the center of or in approximately the center of the grabber plate; ii) a cover comprising: a cover plate comprising a top cover surface and a bottom cover surface, a cover ring operably connected to an outer edge of the cover plate comprising a textured grip positioned on the outside of the cover ring, a cover post comprising a cover rivet mount, and at least a first locking bar positioned along the outer edge of the cover and above the at least a first locking tab a the base plate: and iii) a top spring disposed within the inner cylinder of the grabber body, in operable contact with the grabber and the cover; wherein the grabber body is operably connected to the cover ring such that the grabber and the cover are configured to have independent vertical movement while maintaining the position of the top spring in the slot of the grabber body; c) a rivet positioned through the first and the second rivet mounts and the cover rivet mount, wherein the rear post is operably connected to the cover post by the rivet; and d) a torsion spring comprising a spring body, a first end, and a second end, wherein the spring body is positioned around the rivet, the first end is operably connected to the base plate, and the second end is operably connected to the cover; wherein the top base surface, the bottom grabber surface, or both further comprises one or more of the following: a series of ridges, grooves, bumps, and points; wherein the top section is configured to rotate around the rivet such that the bottom grabber surface is configured to rotate away from the top base surface.

In some embodiments, the devices described herein further comprise a closed position and an open position; wherein in the closed position, the at least a first locking tab and the at least a first locking bar are in, operable contact, such that the top section cannot rotate around the rivet; wherein in the open position, the at least a first locking tab and the at least a first locking bar are not in operable contact, such that the top section can rotate around the rivet; and wherein the button tab is configured to contact the at least a first locking bar and move the device from the closed position to the open position.

The present disclosure also provides methods for securing a knot with a device described herein, the methods comprising: a) placing the knot between the bottom grabber surface and the top base surface: and b) rotating the top section around the rivet such that the bottom grabber surface moves towards the top base surface until, both the bottom grabber surface and the top base surface are in contact with the knot.

The present disclosure also provides devices comprising: a) a base section comprising: i) a base plate comprising at least a top base surface, and ii) a base hinge mount positioned on and operably connected to the top base surface, and operably connected to a living hinge; and b) as top section comprising: i) a grabber comprising: a top grabber surface, a bottom grabber surface, and a grabber notch positioned in or approximately in the center of the grabber; ii) a connector comprising: a connector plate, comprising a top connector surface and a bottom connector surface, and a connector hinge mount, positioned on and operably connected to the bottom connector surface, and operably connected to the living hinge; iii) a cover comprising: a cover plate comprising a top cover surface and a bottom cover surface, and a cover ring operably connected to an outer edge of the cover plate; wherein the grabber and the cover are both operably connected to connector, such that the top grabber surface contacts the bottom connector surface and the bottom cover surface contacts the top connector surface; wherein base section, the connector, and the living hinge are manufactured as a single unit.

The present disclosure also provides devices comprising: a) a base section comprising: i) a base plate comprising at least a top base surface, ii) a base hinge mount positioned on and operably connected to the top base surface, and operably connected to a living hinge, iii) a button tab positioned along the outer edge of the base plate, iv) a locking tab positioned along the upper edge of the button tab, v) a base plate notch in center of or in approximately the center of the base plate; b) a top section comprising: i) a grabber, made out of a compressible material comprising: a) a top grabber surface, b) a bottom grabber surface, c) a grabber notch positioned in the center of or in approximately the center of the plate, and d) a fastener notch positioned in the center of or in approximately the center of the grabber ii) a connector comprising: a) a connector plate, comprising a top connector surface and a bottom connector surface, b) at connector hinge mount, positioned on and operably connected to the bottom connector surface, and operably connected to the living hinge, and c) a fastener notch positioned in the center of or in approximately the center of the connector plate; iii) a cover comprising: a) a cover plate comprising a top cover surface and a bottom cover surface, b) a cover ring operably connected to an outer edge of the cover plate comprising a textured grip positioned on the outside of the cover ring, c) at locking tab positioned along the outer edge of the cover; and iv) a fastener and a washer; wherein the grabber and the cover are both operably connected to connector, such that the top grabber surface contacts the bottom connector surface and the bottom cover surface contacts the top connector surface; and wherein the fastener is positioned through the washer, the fastener notch of the grabber, the fastener notch of the connector plate, and into the cover, such that the fastener holds the washer, the grabber, the connector, and the cover together; wherein the top base surface, the bottom grabber surface, or both further comprises one or more of the following: a series of ridges, grooves, bumps, and points; and wherein the top section is configured to rotate around the living hinge such that the bottom grabber surface rotates away from the top base surface.

In some embodiments, the devices described herein further comprise a closed position and an open position; wherein in the closed position, the locking tab and the locking bar are in operable contact such that the top section cannot rotate around the living hinge; wherein in the open position, the locking tab and the locking bar are not in operable contact, such that the top section can rotate around the living hinge; and wherein the button tab is configured to move the locking bar away from the locking tab, such that the locking tab is no longer in operational contact with the locking bar and the device can move from the closed position to the open position.

The present disclosure also provides methods for securing a knot comprising: a) placing the knot between the bottom grabber surface and the top base surface; and b) rotating the top section around the living hinge such that the bottom grabber surface moves towards the top base surface until both the bottom grabber surface and the top base surface are in contact with the knot.

DETAILED DESCRIPTION

Various terms relating to the systems and methods of the present disclosure are used throughout the specification and claims. Such terms are to be given their ordinary meaning in the art unless otherwise indicated. Other specifically defined terms are to be construed in a manner consistent with the definitions provided herein As used herein, the singular forms "a," "an," and "the" include plural referents unless the content clearly dictates otherwise.

As used herein, the term "plurality" means any amount or number greater than 1.

As used herein, the term "vertical" is an orientation relative to the ground or operating surface.

As used herein, the term "knot" or "shoelace knot" refers to any type of knot used to tighten and secure a shoe. In some embodiments, the shoelace knot is a bow knot. In some embodiments, the shoelace knot is a single knot or a double knot.

As used herein, the term "fastener" refers to any type of material or device that may be used to bring separate materials together. In some embodiments, a fastener is a rod, a rivet, a screw, a bolt, or a dowel. In some embodiments, a fastener is an adhesive, such as glue or resin.

As used herein, the phrase "rotated around the hinge" in reference to a section al any of the devices disclosed herein means that the section is moving around the hinge in a rotational vector. The center of rotation does not need to be at the position of the hinge. In some embodiments, the hinge is a living hinge. In some embodiments, the hinge or elements of the hinge will move, bend, or fold during, the rotation.

Many of the fastenings, connections, and other means and components utilized in this disclosure are widely known and used in the field of the disclosure described, and their exact nature or type is not necessary for an understanding and use of the disclosure by a person skilled in the art, and they will not therefore be discussed in significant detail. Furthermore, the various components shown or described herein for any specific application of this disclosure can be varied and the practice of a specific application of any element may already be widely known or used in the art by persons skilled in the art and each will likewise not therefore be discussed in significant detail.

The present disclosure provides devices that secure shoelace knots by clamping an individual knot between two movable plates. The devices provided herein comprise a bottom base plate and an upper grabber plate that are brought in contact with a knot. The upper grabber plate, together with at least one spring or rubber material, puts pressure on the knot, securing it in place and prevents the knot from coming untied. The devices provided herein also comprise a cover which is positioned over the grabber plate and forms the outermost upper surface of the device.

Figure 1:
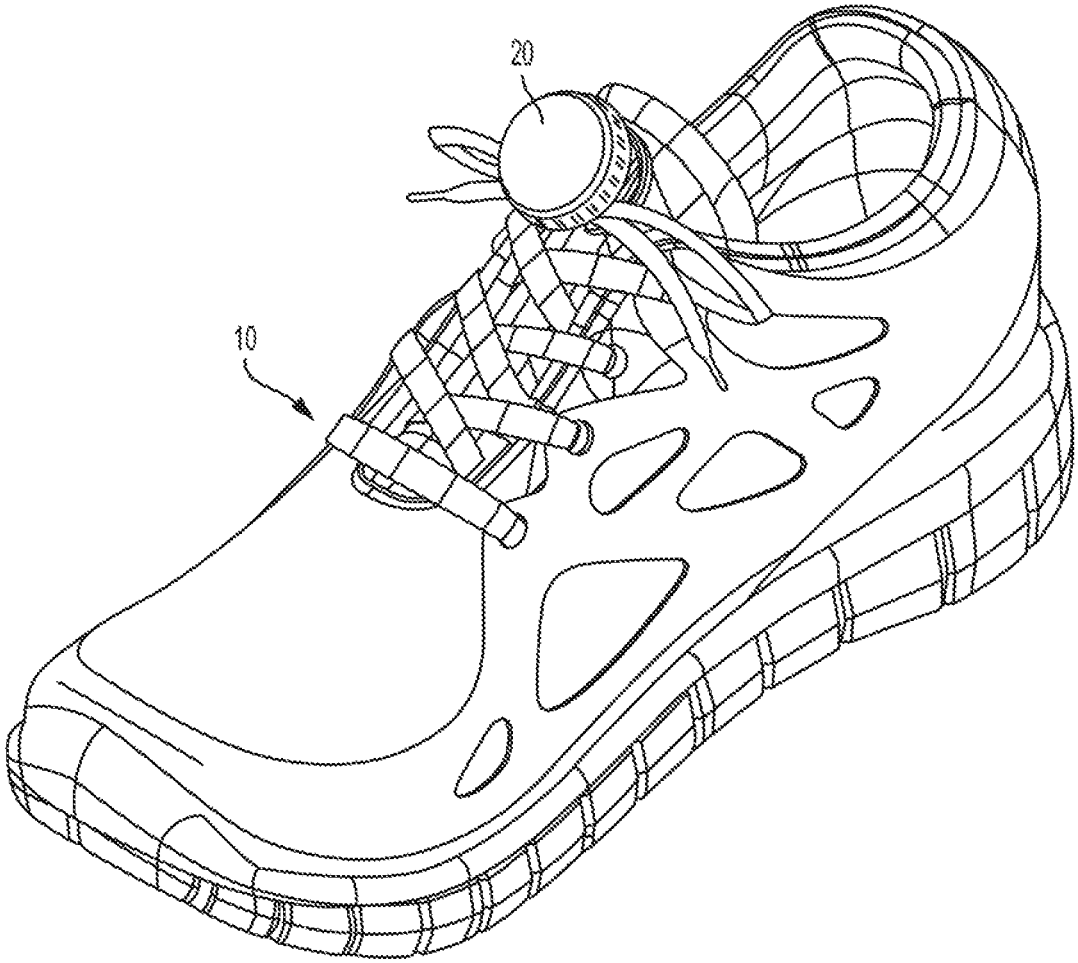
FIG. 1 depicts a shoe with a representative device attached to the knot of the shoe.
Figure 2:
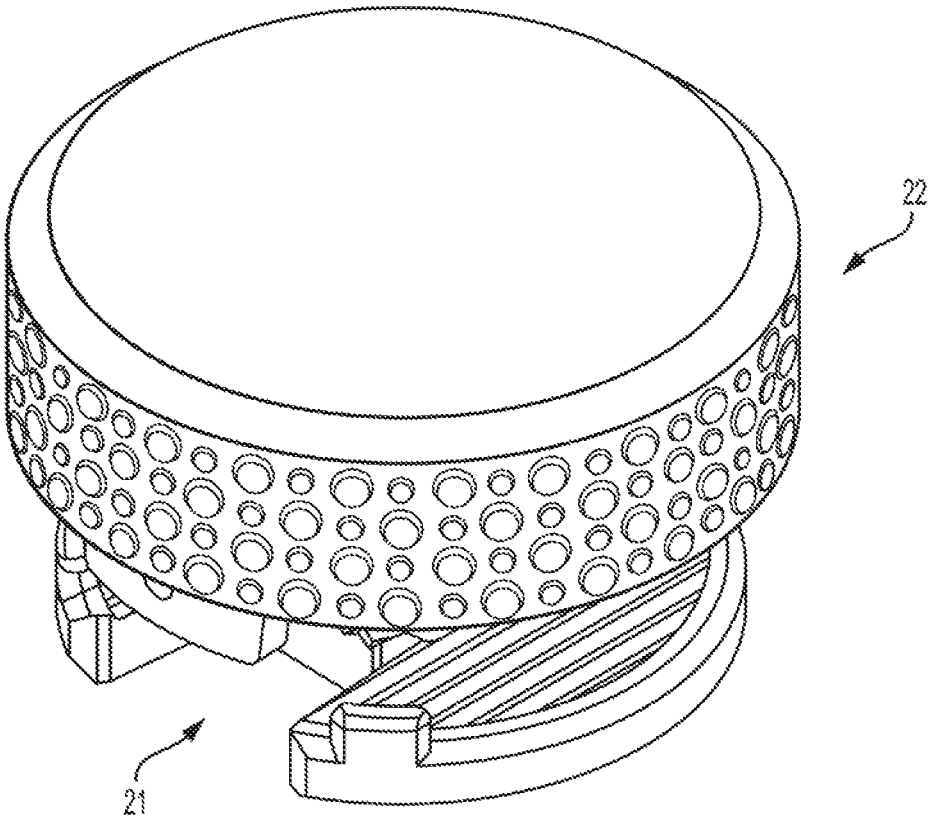
FIG. 2 depicts an embodiment of an assembled device apart from a shoe or knot.

FIG. 1 depicts a generic shoe (10) with a representative device (20) attached to the shoelace knot of the shoe (10). Such a device prevents the shoelace knot from easily coming untied. In some embodiments, the device (20) features a screw design, where a user turns the outer cover to loosen or tighten the device around the knot. In some embodiments, the device features a hinged design. Such a device is depicted separate from any knot in FIG. 2, where the base section (21) is below the top section (22).

Figure 3:
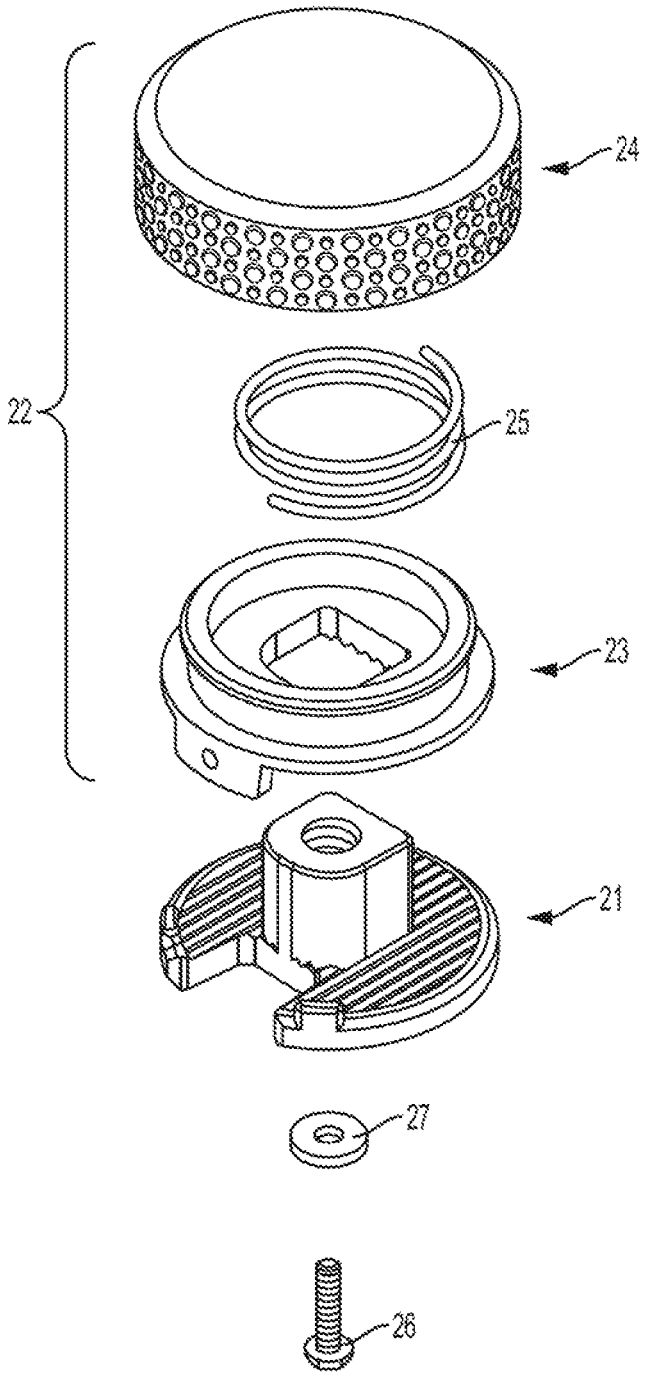
FIG. 3 depicts a representative device separated into its multiple components.

FIG. 3 depicts a representative embodiment of a device separated into several components. The base section (21) is shown, and the top section (22) is separated to show the grabber (23), the cover (24), and the spring (25) which is normally fully encapsulated within the top section (22). Also shown are a fastener (26) and a washer (27) which operably connect the base section (21) with the top section (22). In some embodiments, the fastener is a screw or bolt.

Figure 4A:
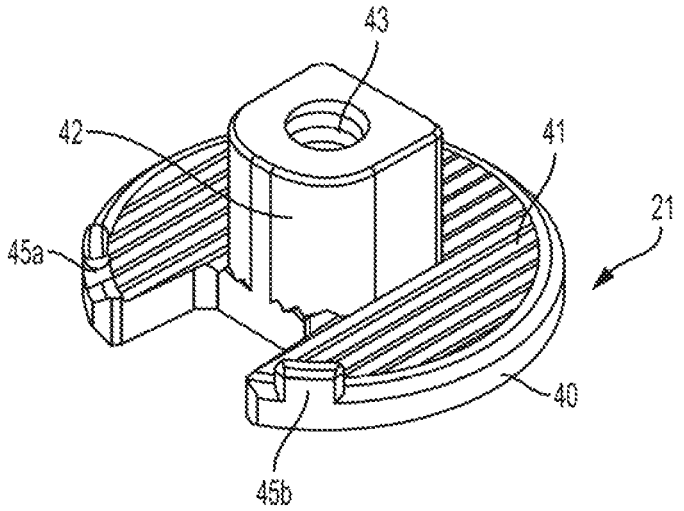
FIGS. 4A and 4B depict various views of a base section of a representative device.
Figure 4B:
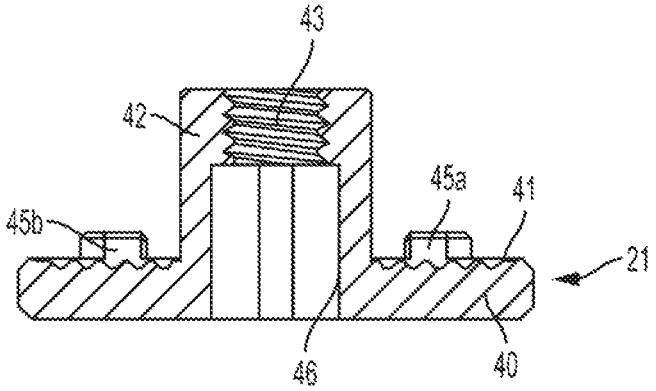

FIGS. 4A and 4B depict a representative embodiment of a base section (21) in greater detail. FIG. 4A depicts the base section (21) from an upper angle viewpoint, while FIG. 4B depicts the base section (21) in cross-section. The base section (21) comprises a base plate (40), which has a top base surface (41). In some embodiments, the top base surface (41) has a series of ridges, grooves, bumps, points, or any combination thereof. The base plate (40) can be of any shape. In some embodiments, the base plate (40) is circular in shape. In some embodiments, the base plate (40) is not completely circular and comprises a notch positioned along the outer edge. In some embodiments, the base plate (40) further comprises at least two lower notch tabs (45*a*, 45*b*), each positioned separately along the outer edge of the base plate (40) and on either side of the notch in the base plate (40).

The base section (21) also comprises a base post (42) positioned on and operably connected to the center of the top base surface (41). In some embodiments, the base post (42) is substantially circular. In some embodiments, the base post (42) is flat or approximately flat on at least one side (as shown in FIG. 4A, for example). The base post (42) comprises a hollow upper cylinder, with threaded walls (43) on the inside surface of the hollow cylinder, that is open towards the upper part of the base post (42) and a hollow lower cylinder, with smooth walls (46) on the inside surface of the hollow cylinder, that is open towards the bottom of the base section (22). In some embodiments, the upper cylinder (43) is operably connected to the lower cylinder (46) by an opening, between them. In some embodiments, the lower cylinder (46) is larger in diameter than the upper cylinder (43). In some embodiments, the base section (21), comprising a base plate (40) with a top base surface (41), at least two lower notch tabs (45*a*, 45*b*), and a base post (42) with a hollow upper cylinder (43) and a hollow lower cylinder (46), is manufactured as a single unit.

Figure 5A:
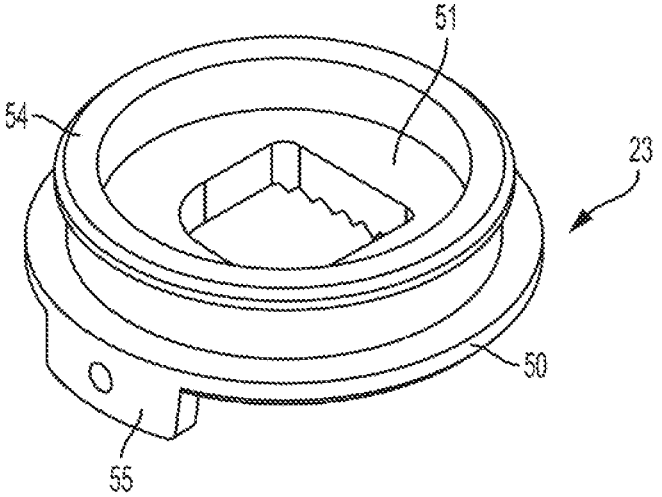
FIGS. 5A and 5B depict various views of a grabber section of a representative device.
Figure 5B:
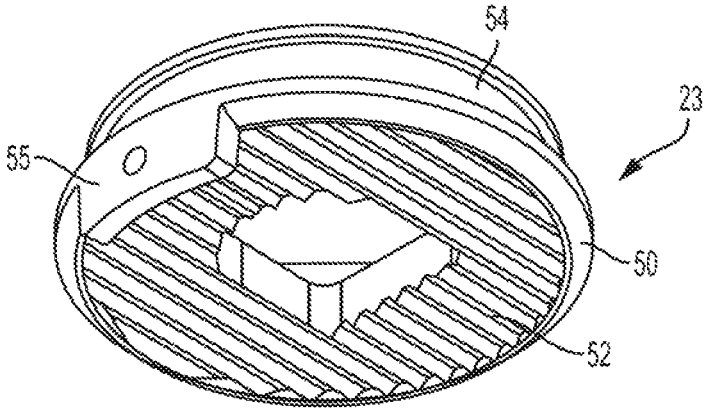

FIGS. 5A and 5B depict a representative embodiment of a grabber (23) in greater detail. FIG. 5A depicts the grabber (23) from an upper viewpoint, while FIG. 5B depicts the grabber (23) from a lower viewpoint. The grabber (23) can be of any shape. In some embodiments, the grabber (23) is circular in shape. The grabber (23) comprises a grabber plate (50), which has a top grabber surface (51) and a bottom grabber surface (52). In some embodiments, the bottom grabber surface (52) has a series of ridges, grooves, bumps, points, or any combination thereof. In some embodiments, the grabber plate further comprises one or more upper notch tabs (55) positioned along the outer edge of the grabber plate (50). In some embodiments, the upper notch tab (55) is configured to be positioned above the notch of the base plate (40) when interacting with the base plate (40). The grabber (23) also comprises a grabber ring (54) positioned on and operably connected to the top grabber surface (51). The grabber (23) is configured to have an opening such that it can receive the base post (42) of the base section (21). In some embodiments, the opening in the grabber (23) is centrally located and approximately matches the circumferential shape of the base post (42). In some embodiments, the grabber (23), comprising a grabber plate (50), having the top grabber surface (51) and bottom grabber surface (52), the grabber ring (54), and one or more upper notch tabs (55), is manufactured as a single unit.

Figure 6A:
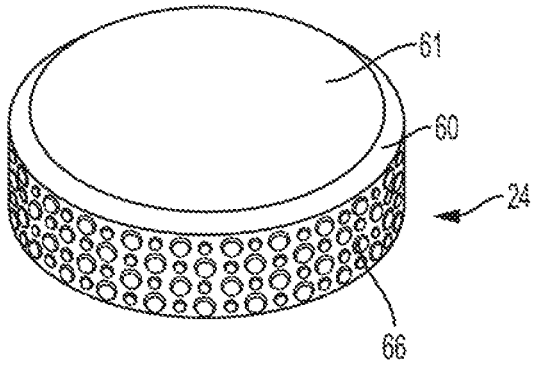
FIGS. 6A, 6B, and 6C depict various views of a cover section of a representative device.
Figure 6B:
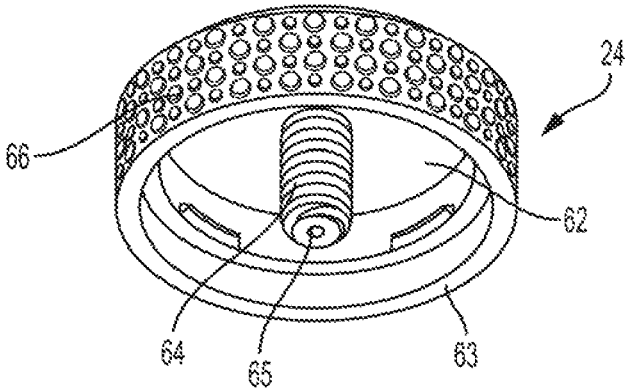
Figure 6C:
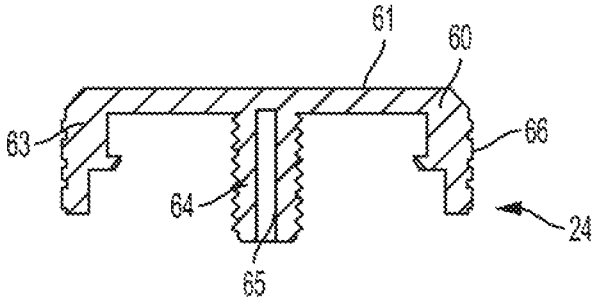

FIGS. 6A, 6B, and 6C depict a representative cover (24) in greater detail. FIG. 6A depicts the cover (24) from an upper viewpoint, FIG. 6B depicts the cover (24) from a lower viewpoint, and FIG. 6C depicts the cover (24) in cross-section. The cover (24) comprises a cover plate (60) which has a top cover surface (61) and a bottom cover surface (62). The cover (24) can be of any shape. In some embodiments, the cover (24) is essentially circular in shape. The cover (24) also comprises a cover ring (66) which is operably connected to the outer edge of the cover plate (60). In some embodiments, the surface of the cover ring (66) is smooth. In some embodiments, the surface of the cover ring (66) has a textured grip positioned on the outside. The cover (24) further comprises a cover post (64) positioned on and operably connected to the bottom cover surface (62). In some embodiments, the cover post (64) is operably connected to the center of the bottom cover surface (62). The cover post (64) comprises a threaded outer surface and a hollow inner cylinder with threaded walls (65) on the inside of the inner cylinder and has an opening towards the bottom of the cover post (64). In some embodiments, the hollow inner cylinder with threaded walls (65) is positioned in the center of the cover post (64). In some embodiments, the cover (24), comprising a cover plate (60), having the top cover surface (61) and bottom cover surface (62), a cover ring (66), and a cover post (64), is manufactured as a single unit.

In any of the embodiments disclosed herein, the cover ring has a cylindrical or approximately cylindrical form. In any of the embodiments disclosed herein, the rover ring has an inner surface that is cylindrical or approximately cylindrical in form, but has an outer surface that is not cylindrical or approximately cylindrical in form. In any of the embodiments disclosed herein, the cover ring can be in the form of another shape, such as, but not limited to, an ellipse, square, regular polygon, irregular, and the like.

Figure 7A:
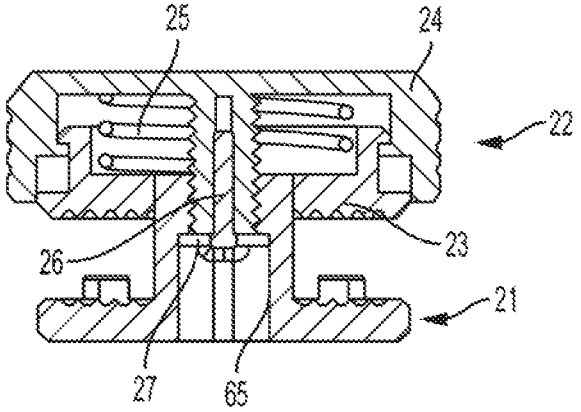
FIGS. 7A and 7B depict various views of an assembled representative device.
Figure 7B:
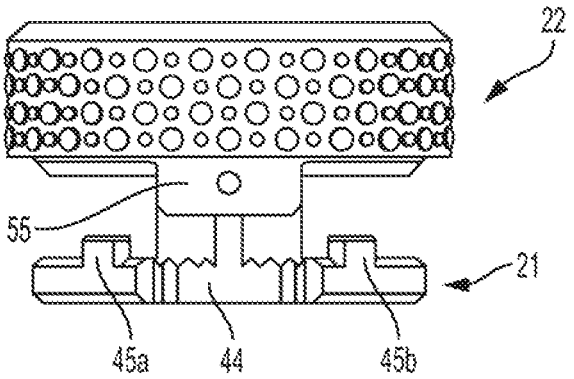

FIGS. 7A and 7B depict a representative assembled device in greater detail. FIG. 7A depicts the device in cross-section, while FIG. 7B depicts the frontal view of the assembled device. FIG. 7A depicts the base section (21) operably connected to the top section (22) by the fastener (26) and the washer (27). The cover post (64) is attached to the upper cylinder of the base post (42). The washer (27) is located within the lower cylinder (46) of the base post (42). In some embodiments, the diameter of the washer (27) is slightly smaller than the diameter of the lower cylinder (46). The fastener (26) is configured to pass through the lower cylinder (46), through the washer (27), and into the inner cylinder (65) of the cover post (64). In some embodiments, the head of the fastener (26) is positioned within the lower cylinder (46). Also depicted is the spring (25) which is positioned between the grabber (23) and the cover (24). The spring (25) is radially disposed around the cover post (64). FIG. 7B depicts a frontal view of the representative device, depicting the upper notch tab (55) positioned over the notch of the base plate. Also depicted are two lower notch tabs (45*a*, 45*b*), each positioned on either side of the notch of the base plate.

In operation, the device depicted in FIGS. 7A and 7B has the grabber ring (54) operably connected to the cover ring (66), such that the grabber (23) and the cover (24) can have independent radial movement of each other while maintaining the position of the spring (25) between them. The base post (42) (see, FIGS. 4A and 4B) is positioned through the opening in the grabber plate (50) (see, FIGS. 5A and 5B), The cover post (64) is also positioned, through the opening in the grabber plate (50). As the cover (24) is rotated such that the cover post (64) is moved further into upper cylinder of the base post (42), the top section (22) moves closer to the bottom section (21) such that the bottom grabber surface (52) moves towards the top base surface (41). As the cover is rotated such that the cover post (64) is moved further out of the upper cylinder of the base post (42), the top section (22) moves away from the bottom section (21), such that the bottom grabber surface (52) moves away from the top base surface (41). In some embodiments, the base post (42) is or is approximately flat on at least one side, and the opening in the grabber plate (50) is configured to receive the base post (42), such that when the base post (42) is positioned within the opening in the grabber plate (50), the grabber (23) is configured to not rotate around the base section (21) when the cover (24) is rotating around the base section (21). The result is that the grabber (23) moves in, a linear up-and-down manner as it slides vertically around the base post (42) while the cover (24) moves in a rotational up-and-down manner as it is positioned into and out of the base post (42).

Figure 8A:
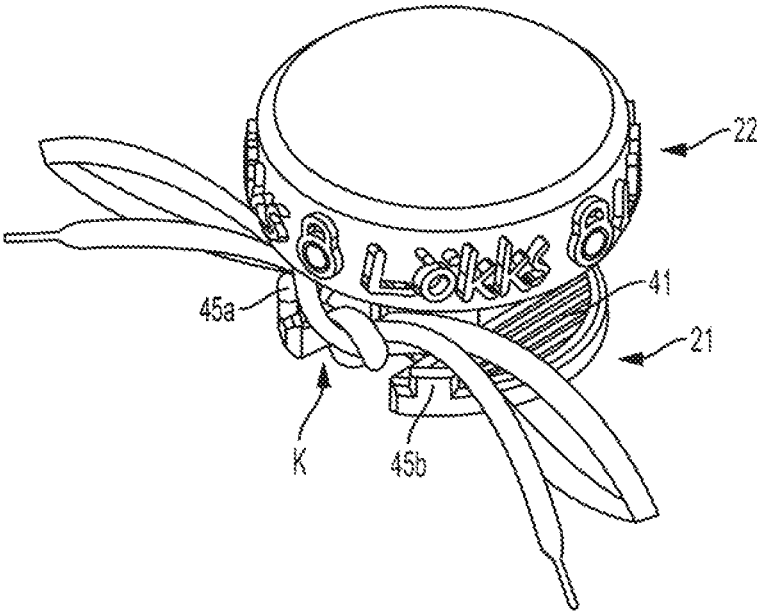
FIGS. 8A and 8B depict various view of a representative device with a shoelace knot.
Figure 8B:
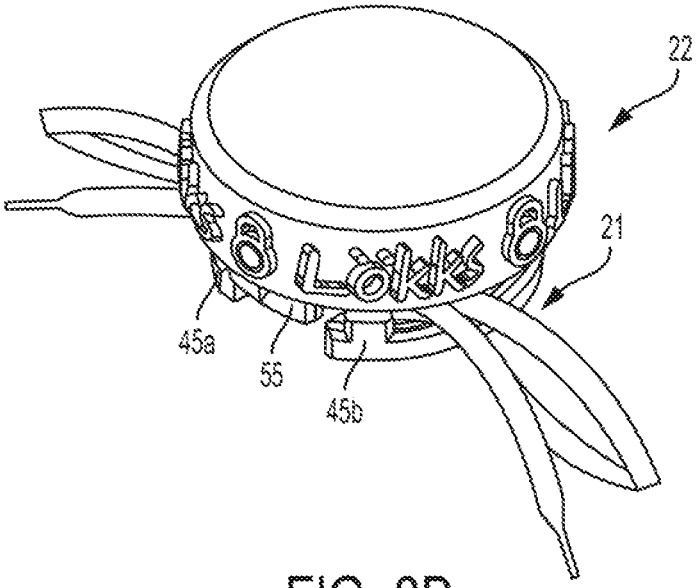

FIGS. 8A and 8B depict a representative device with a shoelace knot (K). In FIG. 8A, the knot (K) is placed within or approximately within the notch of the base (21). The top section (22) is not compressed down on the knot (K). In FIG. 8B, the device is closed down, such that the top section (22) is compressing down on the knot (K). In some embodiments, the knot (K) is held in place by a combination of the top base surface (41) and the bottom grabber surface (52). In some embodiments, the knot (K) is held in place by a combination of the top base surface (41), the bottom grabber surface (52), the two lower notch tabs (45*a*, 45*b*) and the upper notch tab (55). In some embodiments, the knot (K) is compressed by the spring (25) pressing the grabber (23) down on the top of the knot (K).

Figure 9:
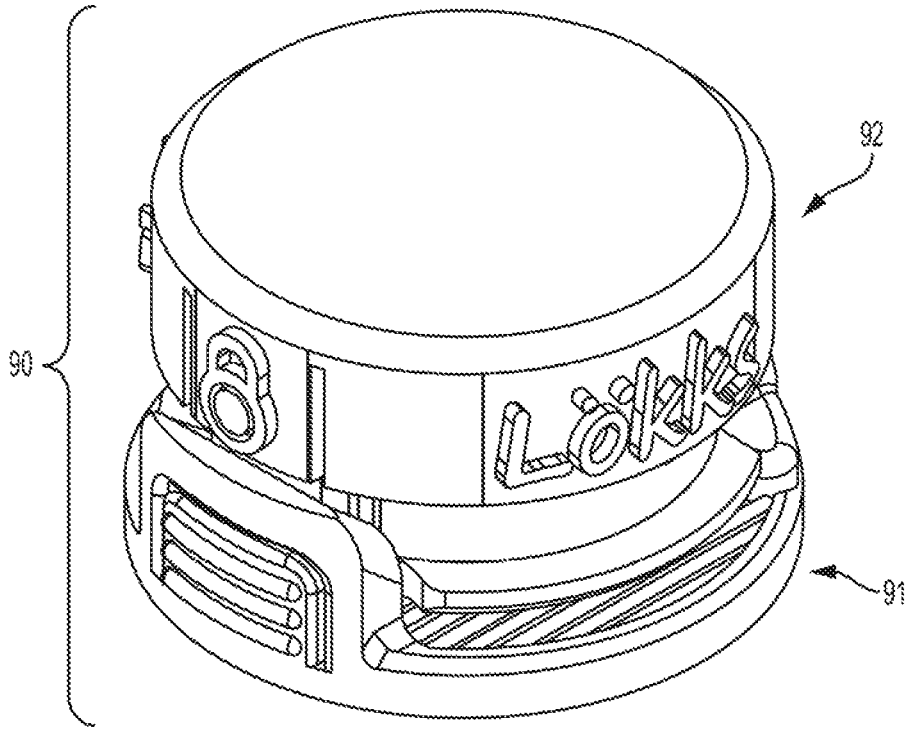
FIG. 9 depicts another embodiment of an assembled representative device apart from a shoe or knot.

In some embodiments, the device features a hinge design, where a user would press the outer cover shut (i.e., in a downward motion) to loosen or tighten the device around the knot. Such a representative device (90) is depicted, separate from any knot, in FIG. 9, where the lower base section (91) is below the larger top section (92).

Figure 10:
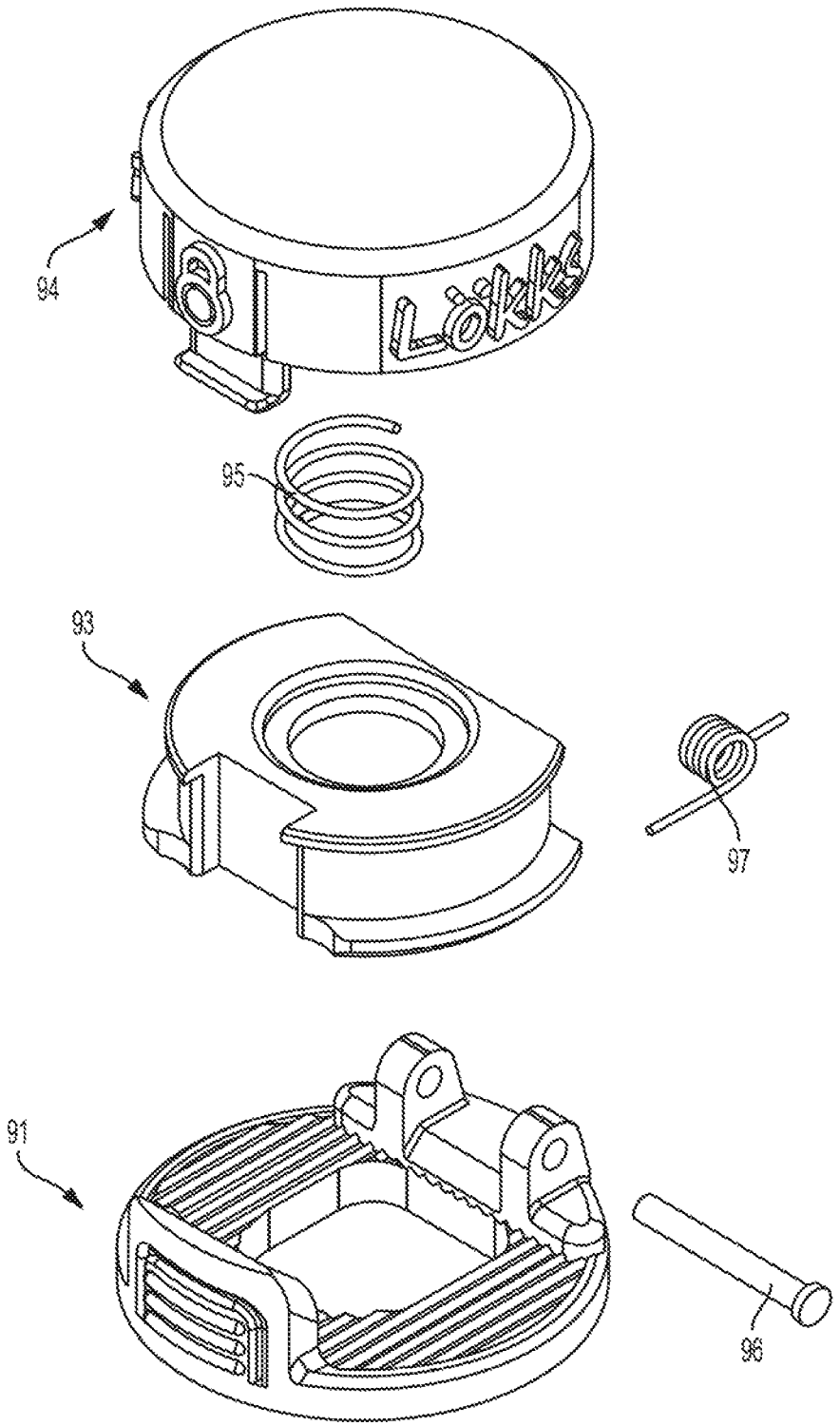
FIG. 10 depicts a representative device separated into its multiple components.

FIG. 10 depicts a representative device (90) separated into several components. The base section (91) is shown, and the top section (92) is separated to show a grabber (93), a cover (94), and a top spring (95) which is normally fully encapsulated within the top section (92). Also shown are a fastener (96) and a torsion spring (97) comprising a spring body, a first end, and a second end. In some embodiments, the fastener is a rivet, dowel, rod, bolt, or screw.

Figure 11:
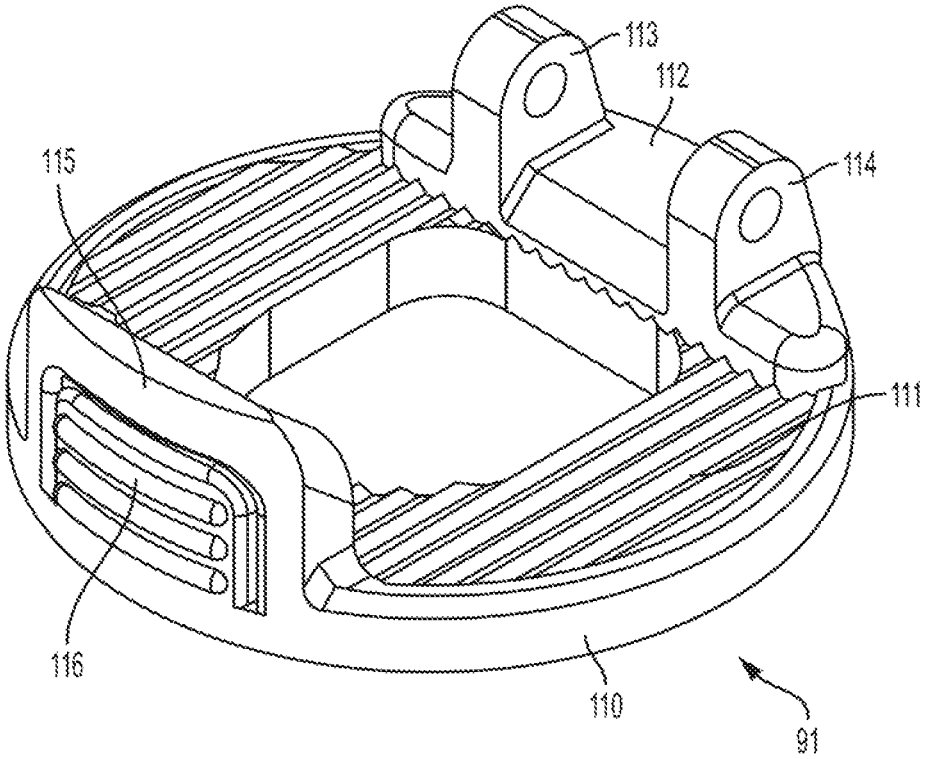
FIG. 11 depicts a base section of a representative device.

FIG. 11 depicts a representative base section (91) in greater detail. The base section (91) comprises a base plate (110), which has a top base surface (111). In some embodiments, the top base surface (111) has a series of ridges, grooves, bumps, points, or any combination thereof. The base plate (110) also comprises a rear post (112) positioned on and operably connected to the top base surface (111). The rear post (112) has a first and a second fastener mount (113, 114), which are configured to hold the fastener (96). In some embodiments, the base section (91) further comprises at least a first locking tab (115) positioned along the outer edge of the base plate (110). In some embodiments, the base section (91) further comprises a button tab (116) positioned along the outer edge of the base plate (110) and below the locking tab (115). In some embodiments, the base section (91) further comprises a base plate notch positioned in the center of or in approximately the center of the base plate (110). In some embodiments, the base section (91), comprising a base plate (110) having the top base surface (11), a rear post (112) having a first and a second fastener mount (113, 114), a first locking tab (115) and a button tab (116), is manufactured as a single unit.

Figure 12:
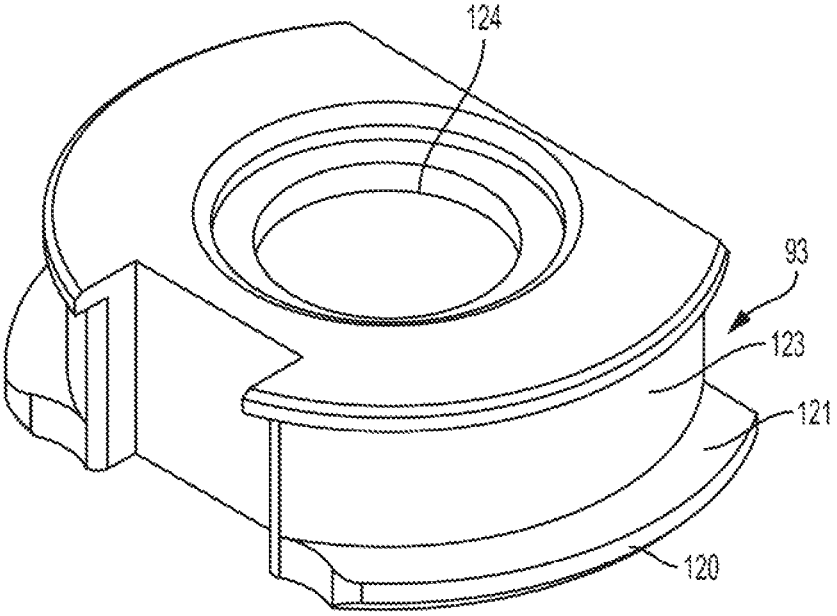
FIG. 12 depicts a grabber section of a representative device.
Figure 14:
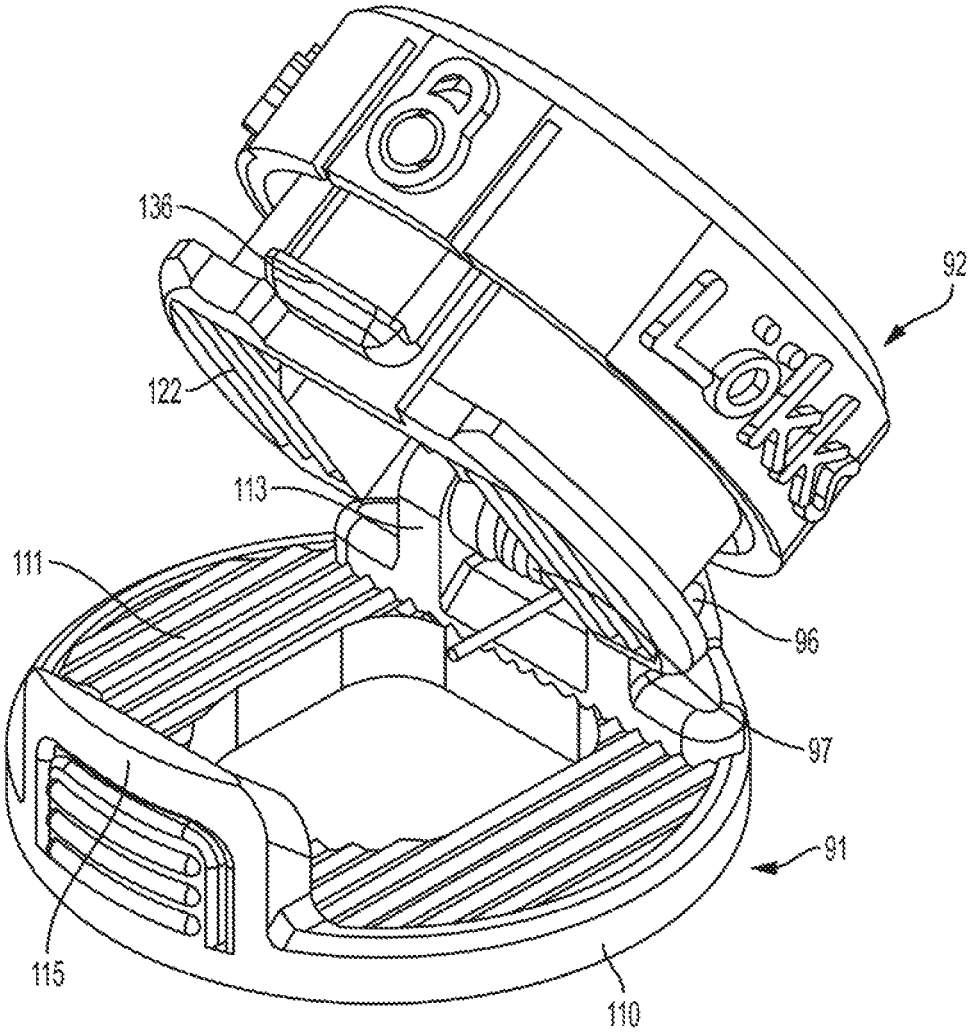
FIG. 14 depicts an open representative device without a shoelace knot.

FIG. 12 depicts a representative grabber (93) in greater detail. The grabber (93) comprises a grabber plate (120) comprising a top grabber surface (121) and a bottom grabber surface (122 as depicted in FIG. 14). In some embodiments, the bottom grabber surface (122) has a series of ridges, grooves, bumps, points, or any combination thereof. The grabber (93) further comprises a grabber body (123) positioned on and operably connected to the top grabber surface (121). In some embodiments, the grabber body (123) comprises a hollow inner cylinder (124) that is open towards the top of the grabber body (123). In some embodiments, the grabber plate (120) further comprises a grabber plate notch (125 as depicted in FIG. 14) in the center of or in approximately the center of the grabber plate (120). In some embodiments, the grabber (93), comprising a grabber plate (120) having the top grabber surface (121) and bottom grabber surface (122), and a grabber body (123) having a hollow inner cylinder (124), is manufactured as a single unit.

Figure 13:
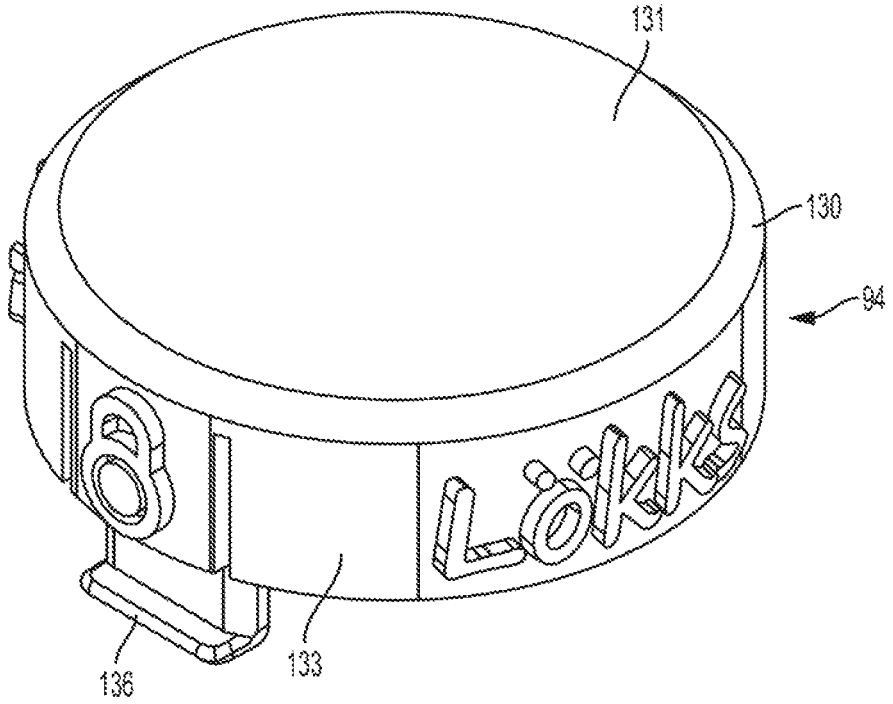
FIG. 13 depicts a cover section of a representative device.

FIG. 13 depicts a representative cover (94) in greater detail. The cover (94) comprises a cover plate (130) comprising a top cover surface (131) and a bottom cover surface (not shown). The cover (94) further comprises a cover ring (133) operably connected to an outer edge of the cover, plate (130). In some embodiments, a textured grip, is positioned on the outside of the cover ring (133). In some embodiments, the cover plate (130), having the top cover surface (131) and bottom cover surface (not shown), and the cover ring (133) are manufactured as a single unit. The cover (94) also comprises a cover post (not shown) positioned on and operably connected to the bottom cover surface. The cover post has a first and a second cover fastener mount (not shown), which are configured to hold the fastener (96). In some embodiments, the cover (94) further comprises a least a first locking bar (136) positioned along the outer edge of the cover (94). In some embodiments, the at least a first locking bar (136) is positioned above the at least a first locking tab (115) of the base section (91). In some embodiments, the cover (94), comprising a cover plate (130), having the top cover surface (131) and bottom cover surface (not shown), the cover ring (133), a cover post (not shown), and a least a first locking bar (136), is manufactured as a single unit.

FIG. 14 depicts a representative assembled device (90) in an open position. The base section (91) is in operable contact with the top section (92) via the fastener (96). The fastener (96) is positioned through the first and the second fastener mounts (113, 114) of the base post (112) and through the first and the second cover fastener mount of the cover (94), allowing both the base section (91) and the top section (92) to rotate around the fastener (96). In some embodiments, the fastener (92) and fastener mounts can be replaced by a hinge. In some embodiments the hinge is a living hinge. In some embodiments, the living hinge is a single piece of material that comprises the base plate (110), a living hinge section, and the cover plate (130). In some embodiments, the fastener and fastener mounts can be replaced by plastic or metal locking tabs. In some embodiments, the torsion spring (97) is in operable contact with the fastener (96), the base section (91) and the cover (94). In some embodiments, the spring body of the torsion spring (97) is positioned around the fastener (96). In some embodiments, the spring body of the torsion spring (97) is position around the fastener (96) and between the first and the second fastener mounts (113, 114) of the base post (112) and through the first and the second cover fastener mount of the cover (94). In some embodiments, the first end of the torsion spring (97) is operably connected to the base plate (110) and the second end of the torsion spring (97) is operably connected to the cover plate (130). In some embodiments, the torsion spring (97) is positioned such that the first and second ends of the torsion spring apply three to the base section (91) and the top section (92), causing the bottom grabber surface (122) to rotate away from the top base surface (111). In the open position depicted in FIG. 14, the first locking tab (115) and the first locking bar (136) are not in operable contact, such that the top section (92) can rotate around the fastener (96). In some embodiments, the grabber plate (120) further comprises a grabber plate notch (125) in the center of or in approximately the center of the grabber plate (120).

FIG. 14 also depicts the grabber (93) and the cover (94) in operable contact with each other. In some embodiments, the grabber body (123) is operably connected to the cover ring (133) such that the grabber (93) and the cover (94) are configured to have independent vertical movement. In some embodiments, the spring (95) is positioned in between the grabber (93) and the cover (94).

Figure 15A:
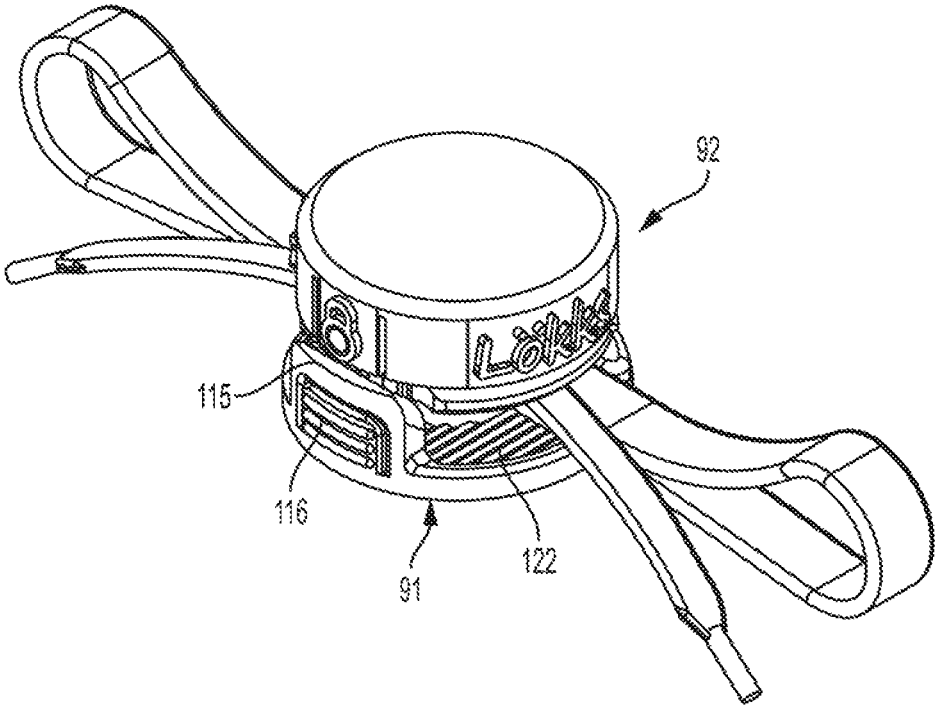
FIGS. 15A and 15B depict various views of a representative device with a shoelace knot.
Figure 15B:
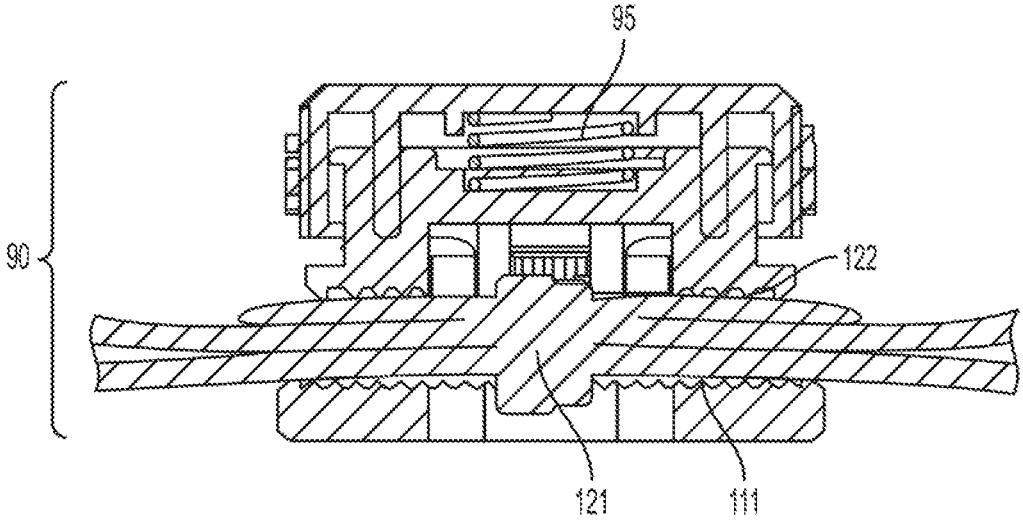

FIGS. 15A and 15B depict a representative assembled device (90) in a closed position with a knot (K1). FIG. 15A depicts the device in a closed position from an upper viewpoint and FIG. 15B depicts a cross-section. The device (90) has been rotated to the closed position, such that the first locking tab (115) and the first locking bar (136) are in operable contact, and the top section (92) cannot rotate around the fastener (96) independently of the base section (91). The bottom grabber surface (122) and the top base surface (111) are in operably contact with the knot (K1). It FIG. 15B, the top spring (95) is shown positioned within the inner cylinder (124) of the grabber body (123). The top spring (95) is also in operable contact with the bottom cover surface (131).

In operation, a knot (K1) is placed in the device between the base section (91) and the top section (92) while the device is in an open position. The top section (92) is rotated around the fastener (96) until the first locking tab (115) and the first locking bar (136) are in operable contact and the device is in the closed position. In some embodiments, the knot (K1) is held in place by a combination of the top base surface (122) and the bottom grabber surface (111). In some embodiments, the knot (K1) is compressed by the spring (95) by pressing the grabber (93) down on the top of the knot (K1). In some embodiments, the knot (K1) is positioned within or approximately within the base plate notch positioned in the center of or in approximately the center of the base plate (110). In some embodiments, the knot (K1) is positioned within or approximately within the grabber plate notch (125) in the center of or in approximately the center of the grabber plate (120). To move the device (90) to an open position and release the knot (K1), the button tab (116) is pressed to contact the first locking bar (136) such that the first locking bar (136) is no longer in operable contact with the first locking tab (115) and the top section (92) can again rotate around the fastener (96) independently of the base section (91).

Figure 16:
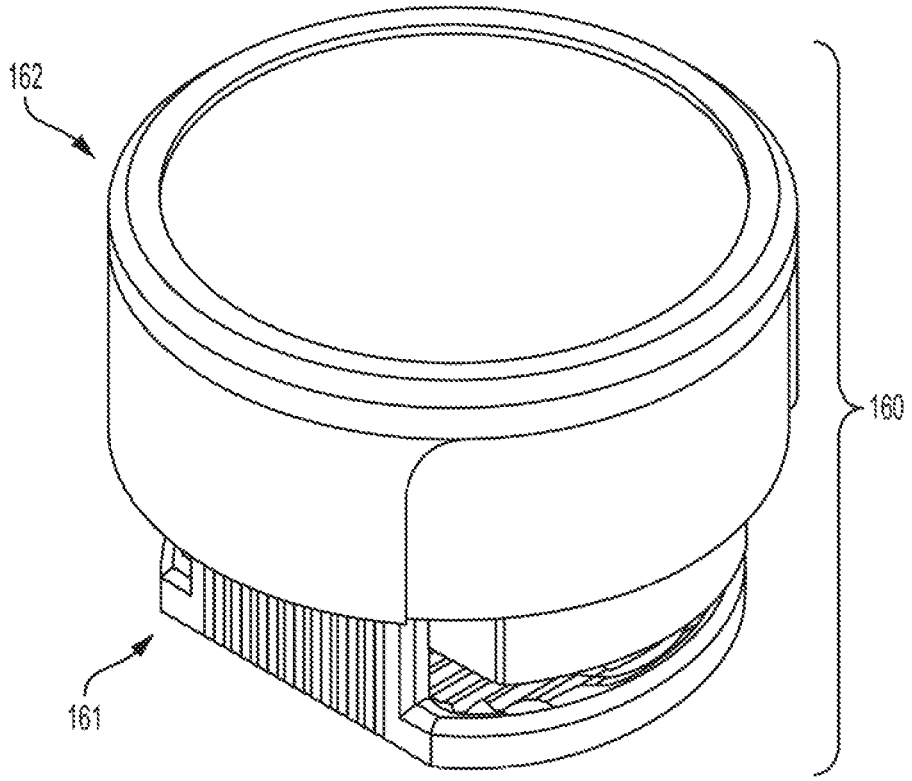
FIG. 16 depicts another embodiments of an assembled representative device apart from a shoe or knot.

In some embodiments, the device features a living hinge design, where a user would press the outer cover shut (i.e., in a downward motion) to loosen or tighten the device around the knot. Such a representative device (160) is depicted, separate from any knot, in FIG. 16, where the lower base section (161) is below the larger top section (162).

Figure 17:
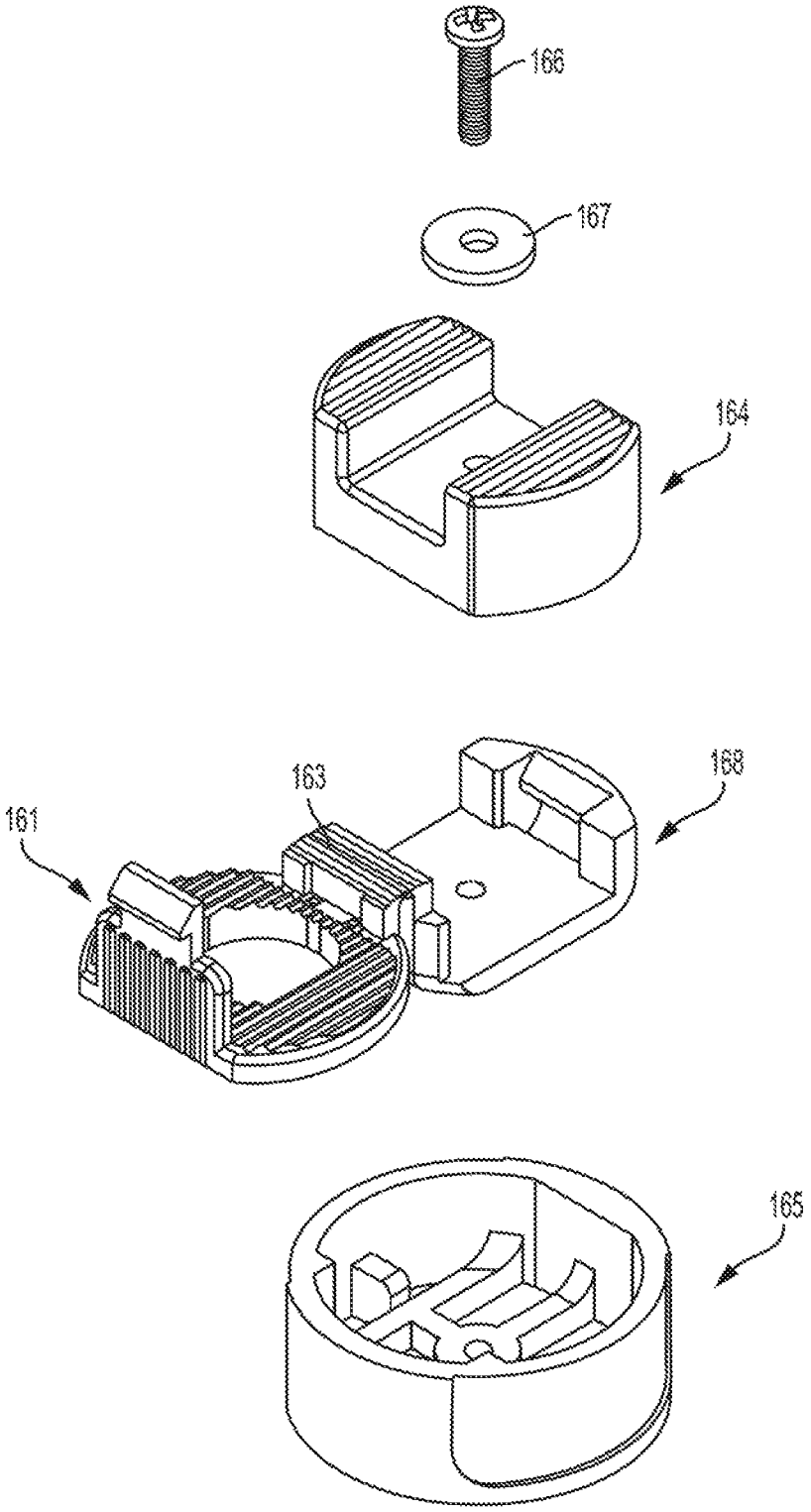
FIG. 17 depicts a representative device separated into its multiple components.

FIG. 17 depicts a representative device (160) separated into several components. The base section (161) is shown, and is attached to a connector (168) by a living hinge (163). The top section (162) is separated to show a grabber (164), a cover (165), which are both normally connected to the connector (168) by a fastener (166) and a washer (167). In some embodiments, the fastener is a rivet, dowel, rod, bolt, or screw.

Figure 18A:
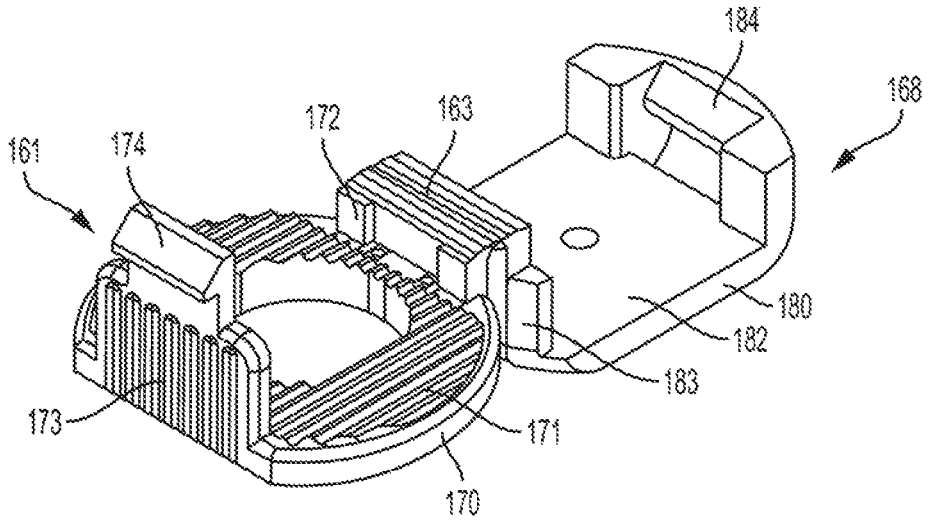
FIGS. 18A and 18B depict a base section and living hinge of a representative device.
Figure 18B:
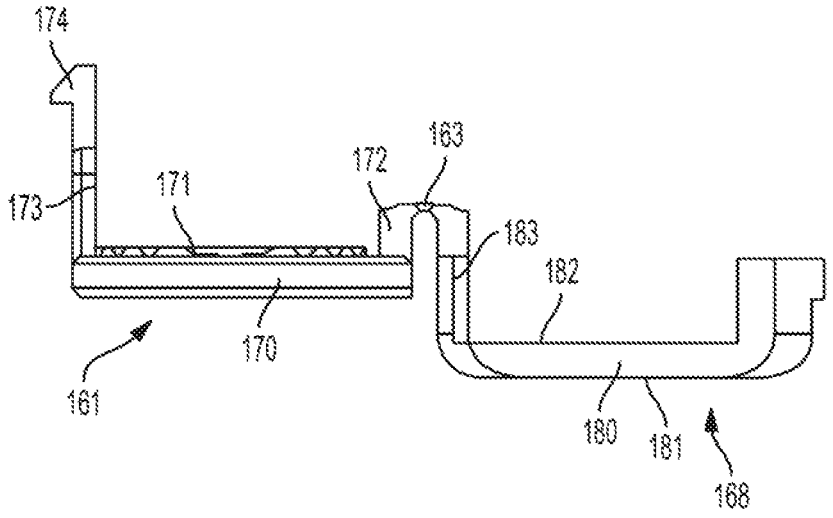

FIGS. 18A and 18B depict a representative base section (161) and connector (168) in greater detail. FIG. 18A depicts the sections from an upper viewpoint and FIG. 18B depicts the sections from a side viewpoint. The base section (161) comprises a base plate (170), which has a top base surface (171). In some embodiments, the top base surface (171) has a series of ridges, grooves, bumps, points, or any combination thereof. The base plate (170) also comprises a base hinge mount (183) positioned on and operably connected to the top base surface (171) and also operably connected to the living hinge (163). In some embodiments, the base section (161) further comprises a button tab (173) positioned along the outer edge of the base plate (170). In some embodiments, the button tab (173) comprises a locking bar (174) positioned along the upper edge of the button tab (173). In some embodiments, the button tab (173) has a series of ridges, grooves, bumps, points, or any combination thereof. In some embodiments, the base section (161) further comprises a base plate notch positioned in the center of or in approximately the center of the base plate (170).

The connector (168) comprises a connector plate (180), which has a top connector surface (181) and a bottom connector surface (182). The connector plate (180) also comprises a connector hinge mount (183), positioned on and operably connected to the bottom connector surface (182) and also operably connected to the living hinge (163). In some embodiments, the connector hinge mount (183) is greater in height than the base hinge mount (183). In some embodiments, the connector (168) further comprises a locking tab (184) operably connected to the connector plate (180). In some embodiments, the connector plate (180) further comprises a fastener notch positioned in the center of or in approximately the center of the connector plate (180).

In some embodiments, the base section (161), comprising the base plate (170), the top base surface (171), the base hinge mount (183), the button tab (173), and the locking bar (174); the connector (168), comprising the connector plate (180), the top connector surface (181), the bottom connector surface (182), the connector hinge mount (183), and the locking tab (184); and the living hinge (163) are manufactured as a single unit.

Figure 19A:
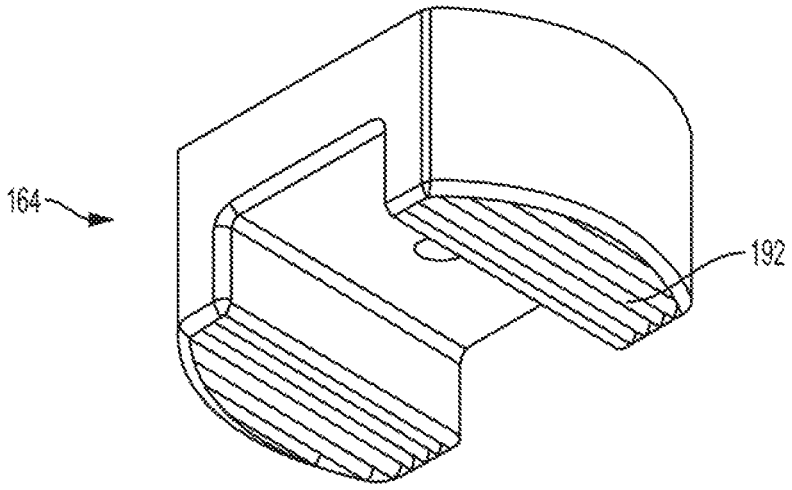
FIGS. 19A and 19B depict a grabber section of a representative device.
Figure 19B:
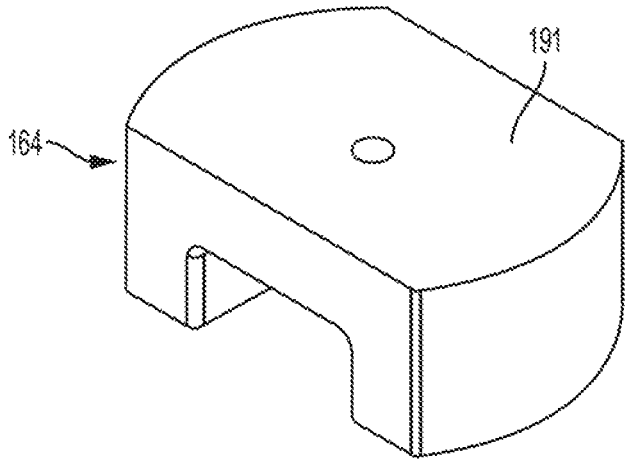

FIGS. 19A and 19B depict a representative grabber (164) in greater detail. FIG. 19A depicts the grabber (164) from a lower viewpoint and FIG. 19B depicts the grabber (164) from an upper viewpoint. The grabber (164) comprises a top grabber surface (191) and a bottom grabber surface (192). In some embodiments, the bottom grabber surface (192) has a series of ridges, grooves, bumps, points, or any combination thereof. In some embodiments, the grabber further comprises a grabber notch in the center of or in approximately the center of the grabber (164). In some embodiments, the grabber notch is about a quarter, about a half, or about three-quarters as deep as the entire thickness of the grabber (164). In some embodiments, the grabber further comprises a fastener notch positioned in the center of in approximately the center of the grabber (164). In some embodiments, the grabber (164), comprising the top grabber surface (191) and the bottom grabber surface (192), is manufactured as a single unit. In some embodiments, the grabber (164) is made of rubber or foam.

Figure 20A:
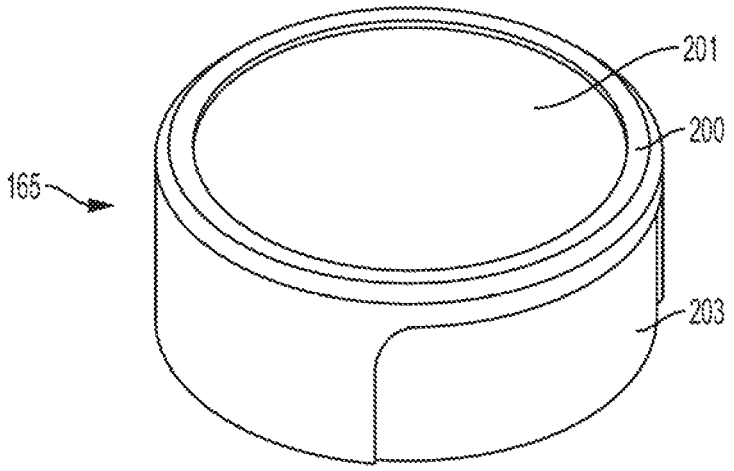
FIGS. 20A and 20B depict a cover section of a representative device.
Figure 20B:
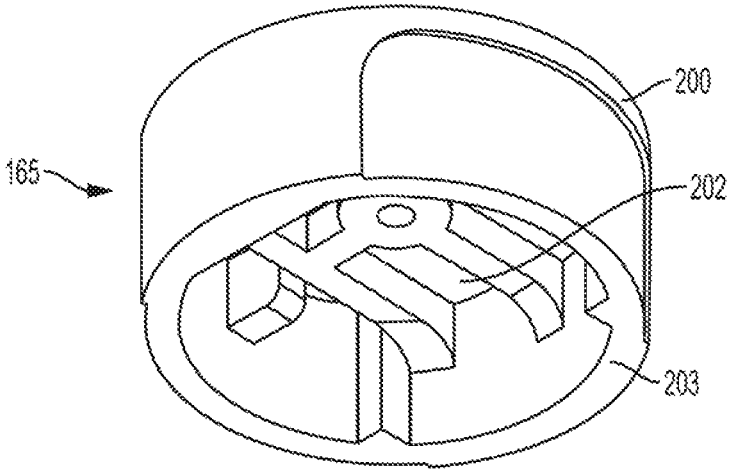

FIGS. 20A and 20B depict a representative cover (165). FIG. 20A depicts the cover (165) from an upper viewpoint and FIG. 20B depicts the cover (165) from a lower viewpoint. The cover (165) comprises a cover plate (200) comprising a top cover surface (201) and a bottom cover surface (202). The cover (165) further comprises a cover ring (203) operably connected to an outer edge of the cover plate (200). In some embodiments, a textured grip is positioned on the outside of the cover ring (203). In some embodiments, the cover plate (200), having the top cover surface (201) and bottom cover surface (202), and the cover ring (203) are manufactured as a single unit. In some embodiments, the cover (165), comprising a cover plate (200), having the top cover surface (201) and bottom cover surface (202), and the cover ring (203), is manufactured as a single unit.

Figure 21A:
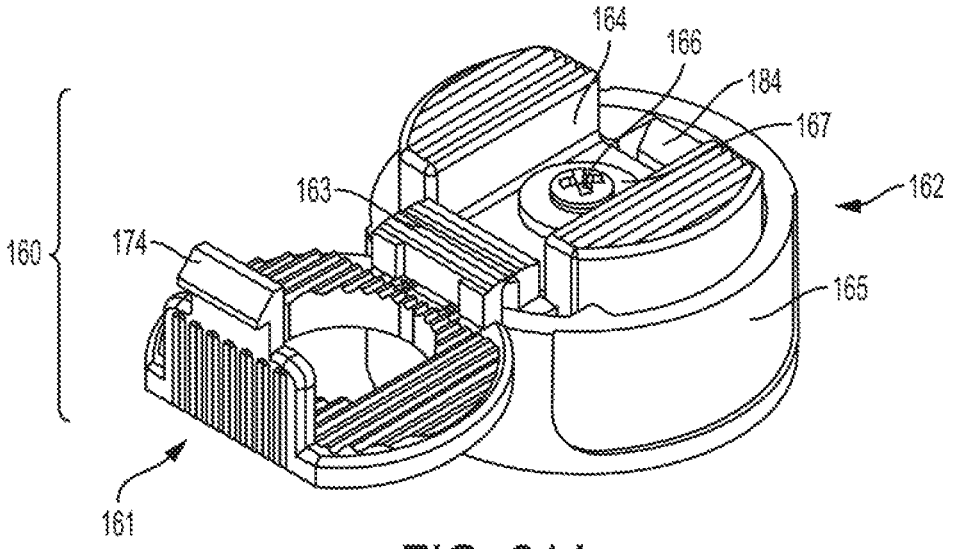
FIG. 21A depicts an open representative device without a shoelace knot.

FIG. 21A depicts a representative assembled device (160) in an open position. The base section (161) is in operable contact with the top section (162) via the living hinge (163). The fastener (166) is positioned through the washer (167), the fastener notch in the grabber (164), the fastener notch in the connector (not shown), and into the cover (165). In some embodiments, the connector (not shown) is in operable contact with both the grabber (164) and the cover (165). In some embodiments, the bottom section (161) and the top section (162) are capable of rotating around the living hinge (163). In the open position depicted in FIG. 21A, the locking tab (184) and the locking bar (174) are not in operable contact.

Figure 21B:
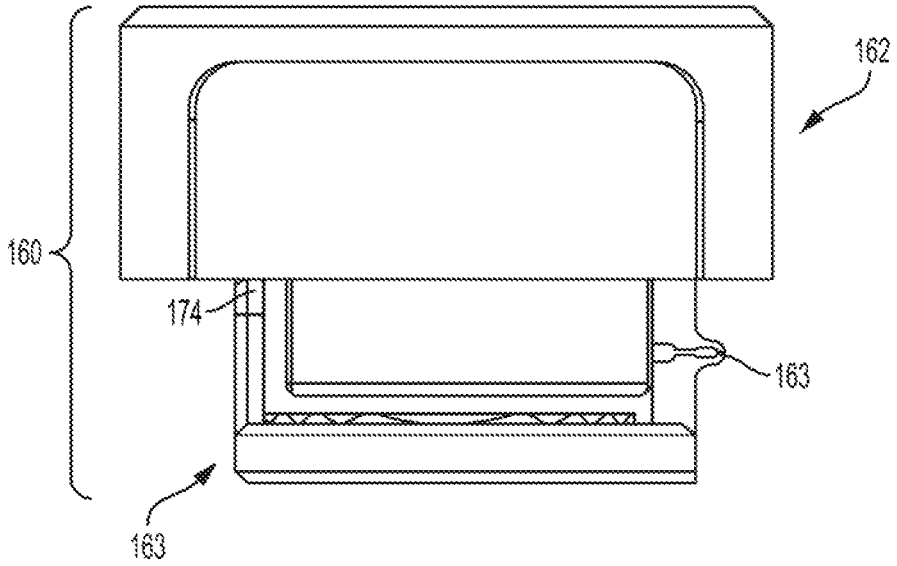
FIG. 21B depicts a closed representative device without a shoelace knot.

FIG. 21B depicts a representative assembled device (160) in a closed position from a side-viewpoint. The device (160) has been rotated to the closed position, such that the locking tab (not shown) and the locking bar (174) are in operable contact, and the top section (162) cannot rotate around the living hinge (163) independently of the base section (161).

In operation, a knot (not shown) is placed in the device (160) between the base section (161) and the top section (162) while the device (160) is in an open position. The top section (162) is rotated around the living hinge (163) until the locking tab (184) and the locking bar (174) are in operable contact and the device is in the closed position. In some embodiments, the knot is held in place by a combination of the top base surface (171) and the bottom grabber surface (192). In some embodiments, the knot is compressed by the grabber (164).

In some embodiments, the grabber is compressible. In some embodiments, the grabber is capable of providing a downward force on the knot. In some embodiments, the knot is position within or approximately within the base plate notch positioned in the center of or in approximately the center of the base plate (170). In some embodiments, the knot is positioned within or approximately within the grabber notch in the center of or in approximately the center of the grabber (164). To move the device (160) to an open position and release the knot, the button tab (173) is pressed, moving the locking bar (174) away from the locking tab (184) such that the locking tab (184) is no longer in operational contact with the locking bar (174) and the top section (162) can again rotate around the living hinge (163) independently of the base section (161).

In any of the embodiments of the devices described herein, the entire device or individual components thereof can be made of any metal, plastic, foam, or rubber known to those skilled in the art. For example, in any of the embodiments of the devices described herein, the grabber can be made of a hard plastic, and the grabber is in operable contact with a metal spring that is encapsulated within the top section of the device, in any of the embodiments of the device described herein, the grabber can be made of rubber or memory foam, such that the spring is eliminated. In any of the embodiments of the device described herein, the grabber plate is made out of hard plastic, and the grabber ring is made of rubber or memory foam.

As described herein, the present disclosure provides methods for securing a knot with the devices provided herein. The knot can be on, for example, an article of footwear, such as a shoe that comprises laces and knots that can be used to keep the shoe secure on the users foot. In some embodiments, the method comprises rotating the top section around the living hinge such that the bottom grabber surface moves towards the top base surface until both the bottom grabber surface and the top base surface are in contact with the knot. The knot can be placed between the bottom grabber surface and the top base surface to secure it using the methods provided herein.

As such, the disclosure also provides for articles of footwear. In some embodiments, the article footwear comprises a shoe comprising a shoelace knot and as provided for herein that secure the shoelace knot.

The devices can be of natural color or can have a color treatment applied thereto. In addition, the devices can have printing or logos printed thereon. In some embodiments, a design or name can be printed on the devices. In some embodiments, the printing, logo, design, or name can be in a format such that are etched into device or in a raised format from the surface of the device. In some embodiments, the devices can have a decorative cover, such as an animal, a face, a diamond or other stone or crystal, an eyeball, a sports ball, a truck, or other two- or three-dimensional shape. In some embodiments, the decorative cover is a sticker. In some embodiments, the decorative cover is a three-dimensional shape that is positioned on top of the top cover surface. In some embodiments, the cover, including any decorative elements, is manufactured as one piece. In some embodiments, the cover, including any decorative elements, is manufactured as two or more pieces. In some embodiments, the devices can comprises one or more of the following: components that light up, components that make sound, components that allow for GPS tracking, components that allow for Bluetooth or other types of wireless communication, and components that allow for a storage compartment. In some embodiments, the device can be packaged by itself, in a pair or multiple pairs, or with one or more pairs of shoelaces or shoes.

Embodiments provided herein also include, but are not limited to:

1. A device comprising a base section operably connected to a top section through a living hinge, wherein:
   a) the base section comprises:
   i) a base plate comprising at least a top base surface, and
   ii) a base hinge mount positioned on and operably connected to the top base surface, and operably connected to the living hinge; and
   b) the top section comprises;
   i) a grabber comprising
      a top grabber surface,
      a bottom grabber surface, and
      a grabber notch positioned in or approximately in the center of the grabber,
   ii) a connector comprising:
      a connector plate, comprising a top connector surface and a bottom connector surface, and
      a connector hinge mount, positioned on and operably connected to the bottom connector surface, and operably connected to the living hinge;
   iii) a cover comprising:
      a cover plate comprising a top cover surface and a bottom cover surface, and
      a cover ring operably connected to an outer edge of the cover plate;

wherein the grabber and the cover are both operably connected to connector, such that the top grabber surface contacts the bottom connector surface and the bottom cover surface contacts the top connector surface.

2. The device of embodiment 1, wherein the top section is configured to rotate around the living hinge such that the bottom grabber surface rotates away from the top base surface.

3. The device of embodiments 1 or 2, wherein the grabber is made of a compressible material.

4. The device of any one of embodiments 1-3, wherein:

the base plate further comprises a button tab positioned along the outer edge of the base plate and a locking bar positioned along the upper of the button tab; and the cover further comprises a locking tab positioned along the outer edge of the cover and above the at least a first locking tab.

5. The device of any one of embodiments 1-4, wherein the device further comprises a closed position and an open position;

wherein in the closed position, the locking tab and the locking bar are in operable contact such that the top section cannot rotate around the living hinge; and wherein in the open position, the locking tab and the locking bar are not in operable contact, such that the top section can rotate around the living hinge.

6. The device of embodiment 5, wherein the button tab is configured to move the locking bar away from the locking tab, such that the locking tab is no longer in operational contact with the locking bar and the device can move from the closed position to the open position.

7. The device of any one of embodiments 1-6, wherein the base plate further comprises a base plate notch in the center of or in approximately the center of the base plate.

8. The device of embodiment 7, wherein the grabber further comprises a grabber notch in the center of or in approximately the center of the grabber plate.

9. The device of any one of embodiments 1-8, wherein the top base surface, the bottom grabber surface, or both further comprises one or more of the following: a series of ridges, grooves, bumps, and points.

10. The device of any one of embodiments 1-9, wherein the further comprises a textured grip positioned on the outside of the cover ring.

11. The device of any one of embodiments 1-10, wherein the device further comprises: a fastener; a washer; a fastener notch positioned in the grabber; and a fastener notch positioned in the connector plate.

12. The device of embodiment 11, wherein the fastener is positioned through the washer, the fastener notch of the grabber, the fastener notch of the connector plate, and into the cover, such that the fastener holds the washer, the grabber, the connector, and the cover together.

13. A device comprising:

a) a base section comprising:

i) a base plate comprising at least a top base surface, ii) a base hinge mount positioned on and operably connected to the top base surface, and operably connected to a living hinge, iii) a button tab positioned along the outer edge of the base plate, iv) a locking tab positioned along the upper edge of the button tab, v) a base plate notch in center of or in approximately the center of the base plate;

b) a top section comprising:

i) a grabber, made out of a compressible material comprising:

a) a top grabber surface, b) a bottom grabber surface, c) a grabber notch positioned in the center of or in approximately the center of the plate, and d) a fastener notch positioned in the center of or in approximately the center of the grabber ii) a connector comprising:

a) a connector plate, comprising a top connector surface and a bottom connector surface, b) a connector hinge mount, positioned on and operably connected to, the bottom connector surface, and operably connected to the living hinge, and c) a fastener notch positioned in the center of or in approximately the center of the connector plate;

iii) a cover comprising:

a) a cover plate comprising a top cover surface and a bottom cover surface, b) a cover ring operably connected to an outer edge of the cover plate comprising a textured grip positioned on the outside of the cover ring, c) at locking tab positioned along the outer edge of the cover; and iv) a fastener and a washer;

wherein the grabber and the cover are both operably connected to connector, such that the top grabber surface contacts the bottom connector surface and the bottom cover surface contacts the top connector surface; and wherein the fastener is positioned through the washer, the fastener notch of the grabber, the fastener notch of the connector plate, and into the cover, such that the fastener holds the washer, the grabber, the connector, and the cover together;

wherein the top base surface, the bottom grabber surface, or both further comprises one or more of the following; a series of ridges, grooves, bumps, and points; and wherein the top section is configured to rotate around the living hinge such that the bottom grabber surface rotates away from the top base surface.

14. The device of embodiment 13, wherein the device further comprises a closed position and an open position;

wherein in the closed position, the locking tab and the locking bar are in operable contact such that the top section cannot, rotate around the living hinge;

wherein in the open position, the locking tab and the locking bar are not in operable contact, such that the top section can rotate around the living hinge; and wherein the button tab is configured to move the locking bar away from the locking tab, such that the locking tab is no longer in operational contact with the locking bar and the device can move from the closed position to the open position.

15. An article of footwear comprising a shoe comprising a shoelace knot and a device of embodiment 14 securing the shoelace knot.

16. A method for securing a knot with the device of any one of embodiments 14-15, comprising:

a) placing the knot between the bottom grabber surface and the top base surface; and b) rotating me top section around the living hinge such that the bottom grabber surface moves towards the top base surface until both the bottom grabber surface and the top base surface are in contact with the knot.

17. The method of embodiment 16, Wherein the knot is a shoelace knot.

18. The method of any one of embodiments 14-17, wherein:

the base plate further comprises a base plate notch in center of or in approximately the center of the base plate; and the grabber further comprises a grabber notch in the center of or in approximately the center of the grabber.

19. The method of embodiment 18, wherein:

when the knot is placed between the bottom grabber surface and the top base surface, the knot is placed over or approximately over the base plate notch; and when the top section is rotated around the rivet such that the bottom grabber surface moves towards the top base surface until both the bottom grabber surface and the top base surface are in contact with the knot, the knot is positioned in or approximately in the base plate notch and the grabber notch.

20. The method of any one of embodiments 16-19, wherein:

the base plate further comprises a button tab positioned along the outer edge of the base plate and a locking bar positioned along the upper of the button tab; and the cover further comprises a locking tab positioned along the outer edge of the cover and above the at least a first locking tab.

21. The method of embodiment 20, wherein the locking tab is in operable contact with the locking bar such that the top section and the bottom section are in a locked position.

22. A device comprising:

a) a base section comprising:

i) a base plate comprising at least a top base surface, and ii) a base post positioned on and operably connected to the top base surface, wherein the base post comprises a hollow upper cylinder with threaded walls on the inside of the hollow cylinder; and b) a top section comprising:

i) a grabber comprising:

a grabber plate comprising a top grabber surface and a bottom grabber surface, wherein the grabber plate comprises an opening, and a grabber ring positioned on and operably connected to the top grabber surface;

ii) a cover comprising:

a cover plate comprising a top cover surface and a bottom cover surface, a cover ring operably connected to an outer edge of the cover plate, and a cover post positioned on and operably connected to the bottom cover surface, wherein the cover post comprises a threaded outer surface; and iii) a spring radially disposed around the cover post;

wherein the grabber ring is operably connected to the cover ring such that the grabber and the cover are configured to have independent radial movement while maintaining, the position of the spring; and wherein the threaded outer surface of the cover post is operably connected to the threaded walls of the upper cylinder in the base post, and the base post is positioned within the opening in the grabber plate.

23. The device of embodiment 22, wherein:

the cover is configured to rotate such that the cover post is moved further into the threaded opening in the base post;

the top base surface is configured to move towards the bottom grabber surface; and the top base surface is configured to move away from the bottom grabber surface when the cover is rotated such that the cover post is moved further out of the threaded opening in the base post.

24. The device of any one of embodiments 22-23, wherein:

in the base section, the base post is substantially centered in the base plate, and the base post further comprises a hollow lower cylinder with smooth walls on the inside of the hollow cylinder positioned below the upper cylinder; wherein the lower cylinder has a larger diameter than the upper cylinder; and the cover post further comprises a hollow inner cylinder with threaded walls on the inside of the cylinder.

25. The device of any one of embodiments 22-24, further comprising a screw and a washer, wherein the threads of the screw are positioned through the washer and into the inner cylinder of the cover post, and wherein the head of the screw and the washer are positioned within the lower cylinder of the base post.

26. The device of any one of embodiments 22-25, wherein:

the base post is or is approximately flat on at least one side; and the opening in the grabber plate is configured to receive the base post, such that the base post is positioned within the opening in the grabber plate and the grabber is configured to not rotate around the base section.

27. The device of any one of embodiments 22-26, wherein:

the base plate further comprises at least a first notch positioned along the outer edge of the base plate; and the grabber plate further comprises at least one upper notch tab positioned along the outer edge of the grabber plate and above the at least a first notch of the base plate.

28. The device of embodiment 27, wherein the base plate further comprises at least two lower notch tabs, each positioned separately along the outer edge of the base plate and on either side of the at least first notch of the base plate.

29. The device of any one of embodiments 22-28, wherein the top base surface, the bottom grabber surface, or both further comprises one or more of the following: a series of ridges, grooves, bumps, and points.

30. The device of any one of embodiments 22-29, wherein the cover further comprises a textured grip positioned on the outside of the cover ring.

31. The device of any one of embodiments 22-30, wherein:

the base post is operably connected to the center of the top base surface;

the opening in the grabber is positioned in the center of the grabber plate; and the cover post is positioned in the center of the bottom cover surface.

32. A device comprising:

a) a base section comprising:

i) a base plate comprising at least a top base surface, and at least a first notch positioned along the outer edge of the base plate, and at least two lower notch tabs, each positioned separately along the outer edge of the base plate and on either side of the at least first notch; and ii) a base post comprising a hollow upper cylinder with threaded walls on the inside of the hollow cylinder, positioned on and operably connected to the center of the top base surface, wherein the base post further comprises a hollow lower cylinder with smooth walls on the inside of the hollow cylinder, positioned below the upper cylinder, wherein the lower cylinder has a larger diameter than upper cylinder;

b) a top section comprising:

i) a grabber comprising:

a grabber plate comprising, a top grabber surface, a bottom grabber surface, and at least one upper notch tab positioned along the outer edge of the grabber plate and above the at least a first notch of the base plate, and a grabber ring positioned on and operably connected to the top grabber surface, wherein the grabber plate comprises an opening therein;

ii) a cover comprising:

a cover plate comprising a top cover surface and a bottom cover surface, a cover ring operably connected to an outer edge of the cover plate, a cover post positioned on and operably connected to the center of the bottom cover surface, wherein the cover post comprises a threaded outer surface, wherein the cover post comprises a hollow inner cylinder positioned substantially in the center of the cover post, wherein the hollow inner cylinder comprises threaded walls on the inside of the cylinder; and a textured grip positioned on the outside of the cover ring; and iii) a spring radially disposed around the cover post;

wherein the grabber ring is operably connected to the cover ring, such that the grabber and the cover are configured to have independent radial movement while maintaining the position of the spring;

c) a screw and a washer, wherein the threads of the screw are positioned through the washer and into the inner cylinder of the cover, and wherein the head of the screw and the washer are positioned within the lower cylinder of the base section;

wherein the threaded outer surface of the cover post is operably connected to the upper cylinder of the base post, and the base post is positioned within the opening in the grabber plate;

wherein the base post is or is approximately flat on at least one side, and the opening in the grabber plate is configured to receive the base post, such that the base post is positioned within the opening in the grabber plate and the grabber is configured to not rotate around the base section;

wherein the top base surface, the bottom grabber surface, or both further comprises one or more of the following; a series of ridges, grooves, humps and points; and wherein the cover is configured to rotate such that the cover post is moved further into the upper cylinder in the base post, wherein the top base surface is configured to move towards the bottom grabber surface; and wherein the top base surface moves away from the bottom grabber surface when the cover is rotated such that the cover post is moved further out of the upper cylinder in the base post.

33. A method for securing a knot with the device of any one of embodiments 22-32, comprising:

a) placing the knot between the bottom grabber surface and the top base surface; and b) rotating the cover such that the bottom grabber surface moves towards the top base surface, until both the bottom grabber surface and the top base surface are in contact with the knot.

34. The method of embodiment 33, wherein the knot is a shoelace knot.

35. The method of any one of embodiments 33-34, wherein the base plate further comprises at least a first notch positioned along the outer edge of the base plate, and wherein the grabber plate further comprises at least one upper notch tab positioned along the outer edge of the grabber plate and above the at least a first notch of the base plate.

36. The method of embodiment 35, wherein when the knot is placed between the bottom grabber surface and the top base surface, the knot is placed over or approximately over the at least first notch; and when the cover is rotated such that the bottom grabber surface moves towards the top base surface until the bottom grabber surface is in contact with the knot, the knot is positioned in or approximately in the at least first notch;

wherein the at least one upper notch tab prevents the knot from moving out of the at least first notch.

37. The method of any one of embodiments 33-36, wherein the base plate further comprises at least two lower notch tabs, each positioned separately along the outer edge of the base plate and on either side of the at least first notch of the base plate.

38. The method of embodiment 37, wherein the at least one upper notch tab and the at least two lower notch tabs prevent the knot from moving out of the at least first notch.

39. A method for securing a shoelace knot with the device of any one of embodiments 22-32, comprising:

a) placing the shoelace knot between the bottom grabber surface and the top base surface, and over or approximately over the at least first notch; and b) rotating the cover such that the bottom grabber surface moves towards the top base surface, until the bottom grabber surface is in contact with the shoelace knot, and the shoelace knot is positioned in or approximately in the at least first notch;

wherein the at least one upper notch tab and the at least two lower notch tabs prevent the shoelace knot from moving out of the at least first notch.

40. A device comprising:

a) a base section comprising:

i) a base plate comprising at least a top base surface, and ii) a rear post positioned on and operably connected to the top base surface, the rear post comprising first and a second rivet mount; and b) a top section comprising:

i) a grabber comprising:

a grabber plate comprising a top grabber surface and a bottom grabber surface, and a grabber body positioned on and operably connected to the top grabber surface, wherein the grabber body comprises a hollow inner cylinder;

ii) a cover comprising:

a cover plate comprising a top cover surface and a bottom cover surface.

a cover ring operably connected to an outer edge of the cover plate, and a cover post comprising a cover rivet mount; and iii) at top spring disposed within the inner cylinder of the grabber body;

wherein the grabber body is operably connected to the cover ring, such that the grabber and the cover are configured to have independent vertical movement while maintaining, the position of the top spring in the inner cylinder of the grabber body;

wherein the rear post is operably connected to the cover post by a rivet positioned through the first and the second rivet mounts and the cover rivet mount.

41. The device of embodiment 40, wherein the top section is configured to rotate around the rivet such that the bottom grabber surface rotates away from the top base surface.

42. The device of any one of embodiments 40-41, further comprising a torsion spring, wherein the torsion spring comprises a spring body, a first end, and a second end, wherein the spring body is positioned around the rivet, the first end is operably connected to the base plate, and the second end is operably connected to the cover.

43. The device of any one of embodiments 40-42, wherein:

the base plate further comprises at least a first locking tab positioned along the outer edge of the base plate; and the cover further comprises at least a first locking bar positioned along the outer edge of the cover and above the at least a first locking tab.

44. The device of embodiment 43, wherein the device further comprises a closed position and an open position wherein in the closed position, the at least a first locking tab and the at least a first locking bar are in operable contact such that the top section cannot rotate around the rivet; and wherein in, the open position, the at least a first locking tab and the at least a first locking bar are not in operable contact, such that the top section can rotate around the rivet.

45. The device any one of embodiments 40-44, wherein the base plate further comprises a button tab positioned along the outer edge of the base plate and below the at least a first locking tab, wherein the button tab is configured to operably contact the at least a first locking bar and move the device from the closed position to the open position.

46. The device of any one of embodiments 40-45, wherein the base plate further comprises a base plate notch in the center of or in approximately the center of the base plate.

47. The device of any one of embodiments 40-46, wherein the grabber plate further comprises a grabber plate notch in the center of or in approximately the center of the grabber plate.

48. The device of any one of embodiments 40-47, wherein the top base surface, the bottom grabber surface, or both further comprises one or more of the following; a series of ridges, grooves, bumps, and points.

49. The device of any one of embodiments 40-48, wherein the cover further comprises a textured grip positioned on the outside of the cover ring.

50. A device comprising:

a) a base section comprising:

i) a base plate comprising at least, a top base surface, ii) a rear post positioned on and operably connected to the top base surface, the rear post comprising a first and a second rivet mount, iii) at least a first locking tab positioned along the outer edge of the base plate, iv) a button tab positioned along the outer edge of the base plate and below the at least a first locking tab, and v) a base plate notch in center of or in approximately the center of the base plate;

b) a top section comprising:

i) a grabber comprising:

a grabber plate comprising a top grabber surface and a bottom grabber surface, a grabber body positioned on and operably connected to the top grabber surface, wherein the grabber body comprises a hollow inner cylinder, and a grabber plate notch in the center of or in approximately the center of the grabber plate;

ii) a cover comprising:

a cover plate comprising a top cover surface and a bottom cover surface, a cover ring operably connected to an outer edge of the cover plate comprising a textured grip positioned on the outside of the cover ring, a cover post comprising a cover rivet mount, and at least a first locking bar positioned along the outer edge of the cover and above the at least a first locking tab of the base plate; and iii) a top spring disposed within the inner cylinder of the grabber body, in operable contact with the grabber and the cover;

wherein the grabber body is operably connected to the cover ring such that the grabber and the cover are configured to have independent vertical movement while maintaining the position of the top spring in the inner cylinder of the grabber body;

c) a rivet positioned through the first and the second rivet mounts and the cover rivet mount, wherein the rear post is operably connected to the cover post by the rivet; and d) a torsion spring comprising a spring body, a first end, and a second end, wherein the spring body is positioned around the rivet, the first end is operably connected to the base plate, and the second end is operably connected to the cover;

wherein the top base surface, the bottom grabber surface, or both further comprises one or more of the following: a series of ridges, grooves, bumps, and points; and wherein the top section is configured to rotate around the rivet such that the bottom grabber surface is configured to rotate away from the top base surface.

51. The device of embodiment 50, wherein the device further comprises a closed position and an open position;

wherein in the closed position, the at least a first locking tab and the at least a first locking bar are in operable contact, such that the top section cannot rotate at around the rivet;

wherein in the open position, the at least a first locking tab and the at least a first locking bar are not in operable contact, such that the top section can rotate around the rivet; and wherein the button tab is configured to contact the at least a first locking bar and move the device from the closed position to the open position.

52. A method for securing a knot with the device of any one of embodiments 40-51, comprising:

a) placing the knot between the bottom grabber surface and the top base surface; and b) rotating the top section around the rivet such that the bottom grabber surface moves towards the top base surface until both the bottom grabber surface and the top base surface are in contact with the knot.

53. The method of embodiment 52, wherein the knot is a shoelace knot.

54. The method of any one of embodiments 52-53, wherein:

the base plate further comprises a base plate notch in center of or in approximately the center of the base plate; and the grabber plate further comprises a grabber plate notch in the center of or in approximately the center of the grabber plate.

55. The method of embodiment 54, wherein:

when the knot is placed between the bottom grabber surface and the top base surface, the knot is placed over or approximately over the base plate notch; and when the top section is rotated around the rivet such that the bottom grabber surface moves towards the top base surface until both the bottom grabber surface and the top base surface are in contact with the knot, the knot is positioned in or approximately in the base plate notch and the grabber plate notch.

56. The method of any one of embodiments 52-55, wherein:

the base plate further comprises at least a first locking tab positioned along the outer edge of the base plate, a button tab positioned along the outer edge of the base plate and below the at least a first locking tab; and the cover further comprises at least a first locking bar positioned along the outer edge of the cover and above the at least a first locking tab of the base plate.

57. The method of embodiment 56, wherein the at least a first locking bar is in operable contact with the at least a first locking tab such that the top section and the bottom section are in a locked position.

Having described a series of embodiments, it will become apparent that various modifications can be made without departing from the scope of the disclosure as defined in the accompanying claims.

What is claimed is:

1. A device comprising a base section operably connected to a top section through a living hinge, wherein:

a) the base section comprises:

i) a base plate comprising at least a top base surface, and ii) a base hinge mount positioned on and operably connected to the top base surface, and operably connected to the living hinge; and b) the top section comprises:

i) a grabber comprising:

a top grabber surface, a bottom grabber surface, and a grabber notch positioned in or approximately in the center of the grabber;

ii) a connector comprising:

a connector plate, comprising a top connector surface and a bottom connector surface, and a connector hinge mount, positioned on and operably connected to the bottom connector surface, and operably connected to the living hinge;

iii) a cover comprising:

a cover plate comprising a top cover surface and a bottom cover surface, and a cover ring operably connected to an outer edge of the cover plate;

wherein the grabber and the cover are both operably connected to connector, such that the top grabber surface contacts the bottom connector surface and the bottom cover surface contacts the top connector surface.

2. The device of claim 1, wherein the top section is configured to rotate around the living hinge such that the bottom grabber surface rotates away from the top base surface.

3. The device of claim 1, wherein the grabber is made of a compressible material.

4. The device of claim 1, wherein:

the base plate further comprises a button tab positioned along the outer edge of the base plate and a locking bar positioned along the upper of the button tab; and the cover further comprises a locking tab positioned along the outer edge of the cover and above the at least a first locking tab.

5. The device of claim 4, wherein the device further comprises a closed position and an open position;

wherein in the closed position, the locking tab and the locking bar are in operable contact such that the top section cannot rotate around the living hinge; and wherein in the open position, the locking tab and the locking bar are not in operable contact, such that the top section can rotate around the living hinge.

6. The device of claim 5, wherein the button tab is configured to move the locking bar away from the locking tab, such that the locking tab is no longer in operational contact with the locking bar and the device can move from the closed position to the open position.

7. The device of claim 1, wherein the base plate further comprises a base plate notch in the center of or in approximately the center of the base plate.

8. The device of claim 7, wherein the grabber further comprises a grabber notch in the center of or in approximately the center of the grabber plate.

9. A device comprising:

a) a base section comprising:

i) a base plate comprising at least a top base surface, ii) a base hinge mount positioned on and operably connected to the top base surface, and operably connected to a living hinge, iii) a button tab positioned along the outer edge of the base plate, iv) a locking tab positioned along the upper edge of the button tab, v) a base plate notch in center of or in approximately the center of the base plate;

b) a top section comprising:

i) a grabber, made out of a compressible material comprising:

a) a top grabber surface, b) a bottom grabber surface, c) a grabber notch positioned in the center of or in approximately the center of the plate, and d) a fastener notch positioned in the center of or in approximately the center of the grabber ii) a connector comprising:

a) a connector plate, comprising a top connector surface and a bottom connector surface, b) a connector hinge mount, positioned on and operably connected to the bottom connector surface, and operably connected to the living hinge, and c) a fastener notch positioned in the center of or in approximately the center of the connector plate;

iii) a cover comprising:

a) a cover plate comprising a top cover surface and a bottom cover surface, b) a cover ring operably connected to an outer edge of the cover plate comprising a textured grip positioned on the outside of the cover ring, c) at locking tab positioned along the outer edge of the cover; and iv) a fastener and a washer;

wherein the grabber and the cover are both operably connected to connector, such that the top grabber surface contacts the bottom connector surface and the bottom cover surface contacts the top connector surface; and wherein the fastener is positioned through the washer, the fastener notch of the grabber, the fastener notch of the connector plate, and into the cover, such that the fastener holds the washer, the grabber, the connector, and the cover together;

wherein the top base surface, the bottom grabber surface, or both further comprises one or more of the following: a series of ridges, grooves, bumps, and points; and wherein the top section is configured to rotate around the living hinge such that the bottom grabber surface rotates away from the top base surface.

10. The device of claim 9, wherein the device further comprises a closed position and an open position;

wherein in the closed position, the locking tab and the locking bar are in operable contact such that the top section cannot rotate around the living hinge;

wherein in the open position, the locking tab and the locking bar are not in operable contact, such that the top section can rotate around the living hinge; and wherein the button tab is configured to move the locking bar away from the locking tab, such that the locking tab is no longer in operational contact with the locking bar and the device can move from the closed position to the open position.

11. An article of footwear comprising a shoe comprising a shoelace knot and a device of claim 10 securing the shoelace knot.

12. A method for securing a knot with the device of claim 10, comprising:

a) placing the knot between the bottom grabber surface and the top base surface; and b) rotating the top section around the living hinge such that the bottom grabber surface moves towards the top base surface until both the bottom grabber surface and the top base surface are in contact with the knot.

* * * * *